US008236728B2

(12) United States Patent
Yokozawa

(10) Patent No.: US 8,236,728 B2
(45) Date of Patent: Aug. 7, 2012

(54) HEAT-SENSITIVE TRANSFER SHEET

(75) Inventor: Akito Yokozawa, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 1010 days.

(21) Appl. No.: 12/200,770

(22) Filed: Aug. 28, 2008

(65) Prior Publication Data

US 2009/0060131 A1 Mar. 5, 2009

(30) Foreign Application Priority Data

Aug. 29, 2007 (JP) ..... 2007-223207

(51) Int. Cl.
*B41M 5/035* (2006.01)
*B41M 5/385* (2006.01)

(52) U.S. Cl. ..... 503/227; 428/32.66

(58) Field of Classification Search ..... None
See application file for complete search history.

(56) References Cited

U.S. PATENT DOCUMENTS 5,714,434 A * 2/1998 Takeuchi et al. ..... 503/227

FOREIGN PATENT DOCUMENTS

| | | | |
|---|---|---|---|
| EP | 0 523 623 | A1 | 1/1993 |
| EP | 0 577 051 | A1 | 1/1994 |
| EP | 0 820 875 | A1 | 1/1998 |
| JP | 2591636 | B2 | 12/1996 |
| JP | 10-71773 | A | 3/1998 |
| JP | 341057 | B2 | 3/2003 |

* cited by examiner

*Primary Examiner* — Bruce H Hess

(74) *Attorney, Agent, or Firm* — Sughrue Mion, PLLC

(57) ABSTRACT

A heat-sensitive transfer sheet containing a base film, a dye layer formed over one surface of the base film and containing a heat-transferable dye and a resin, and a heat-resistant lubricating layer formed over the other surface of the base film and containing a lubricant and a resin, wherein the heat-resistant lubricating layer contains a specific phosphate ester as the lubricant, and the maximum value of the following characteristic X-ray intensities is at least 5 times the minimum value thereof: characteristic X-ray intensities obtained by radiating an electron beam which is accelerated to 20 kV and has a beam diameter of 1 μm or less onto plural positions of the heat-sensitive transfer sheet from the heat-resistant lubricating layer side of this sheet, and measuring the resultant characteristic X-rays originating from the K-line of the phosphorus element in the heat-resistant lubricating layer by an energy dispersive X-ray spectrometer.

14 Claims, No Drawings

HEAT-SENSITIVE TRANSFER SHEET

FIELD OF THE INVENTION

The present invention relates to a heat-sensitive transfer sheet for reproducing an image in which image defects are suppressed and a high density is attained.

BACKGROUND OF THE INVENTION

Various heat transfer recording methods have been known so far. Among these methods, dye diffusion transfer recording systems attract attention as a process that can produce a color hard copy having an image quality closest to that of silver halide photography. Moreover, this system has advantages over silver halide photography: it is a dry system, it enables direct visualization from digital data, it makes reproduction simple, and the like.

In this dye diffusion transfer recording system, a heat-sensitive transfer sheet (hereinafter also referred to as an ink sheet) containing dyes is superposed on a heat-sensitive transfer image-receiving sheet (hereinafter also referred to as an image-receiving sheet), and then the ink sheet is heated by a thermal head whose exothermic action is controlled by electric signals, in order to transfer the dyes contained in the ink sheet to the image-receiving sheet, thereby recording an image information. Three colors: cyan, magenta, and yellow, are used for recording a color image by overlapping one color to other, thereby enabling transferring and recording a color image having continuous gradation for color densities.

Recently, various printers allowing higher-speed printing have been developed and commercialized increasingly in the field of the dye-diffusion transfer recording systems. The high speed print enables to shorten a waiting time when a user obtains a print in a shop. For the foregoing reason, there is a demand for further speeding up of printing.

In order to prevent thermal sticking between a thermal printer head of a printer and an ink sheet and to give the thermal printer head and the ink sheet a slipping property therebetween, a heat-resistant lubricating layer is formed on the ink sheet surface contacting the thermal printer head. The thermal sticking occurs in a case where there is a break of the ink ribbon or the slipping property of the ink ribbon is insufficient when an image is printed, whereby image defects may be generated because the ink sheet is stretched or creased, or deformed into some other form at the printing time. According to high-speed printing, a thermal printer head comes to contact the heat-resistant lubricating layer at a higher temperature and a higher speed. Thus, the heat-resistant lubricating layer is desired to have even better performances.

For example, Japanese Patent No. 2,591,636 discloses a technique of forming a hard heat-resistant lubricating layer having a high crosslinkage density mainly from polyisocyanate, thereby giving heat resistance and lubricity to the layer. Moreover, Japanese Patent No. 3,410,157 discloses a technique of incorporating a phosphate ester-series surfactant excellent in lubricity into a lubricating layer, and further incorporating, into the layer, magnesium hydroxide and particles having a Mohs' hardness less than 3 as neutralizing agents in order to restrain corrosion or abrasion of a thermal printer head by decomposition of the phosphate ester.

The inventors have investigated improvements on performances of a heat-resistant lubricating layer of an ink sheet by use of the techniques described in the above-mentioned Japanese Patents, in high-speed printing. As a result, the inventors have found out that a new problem that the transferred dye density falls is caused although the lubricity between the heat-resistant lubricating layer and a thermal printer head can be certainly kept. In order to compensate for the fall in the transferred dye density, it is thought that the amount of the colorant (dye) contained in the dye layer is increased, but it has a problem that costs increase.

SUMMARY OF THE INVENTION

The present invention resides in a heat-sensitive transfer sheet comprising a base film, a dye layer formed over one surface of the base film and containing a heat-transferable dye and a resin, and a heat-resistant lubricating layer formed over the other surface of the base film and containing a lubricant and a resin, wherein the heat-resistant lubricating layer contains a phosphate ester represented by the following formula (I) as the lubricant, and the maximum value of the following characteristic X-ray intensities is at least 5 times the minimum value thereof: characteristic X-ray intensities obtained by radiating an electron beam which is accelerated to 20 kV and has a beam diameter of 1 μm or less onto plural positions of the heat-sensitive transfer sheet from the heat-resistant lubricating layer side of this sheet, and measuring the resultant characteristic X-rays originating from the K-line of the phosphorus element in the heat-resistant lubricating layer by means of an energy dispersive X-ray spectrometer:

Formula (I)

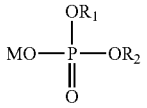

wherein M represents a hydrogen atom or a monovalent metal, $R_1$ represents a hydrogen atom, a monovalent metal, an alkyl group which may have a substituent, an alkenyl group which may have a substituent, or an aromatic group which may have a substituent, and $R_2$ represents an alkyl group which may have a substituent, an alkenyl group which may have a substituent, or an aromatic group which may have a substituent.

Other and further features and advantages of the invention will appear more fully from the following description.

DETAILED DESCRIPTION OF THE INVENTION

According to the present invention, there is provided the following means:

(1) A heat-sensitive transfer sheet comprising a base film, a dye layer formed over one surface of the base film and containing a heat-transferable dye and a resin, and a heat-resistant lubricating layer formed over the other surface of the base film and containing a lubricant and a resin, wherein the heat-resistant lubricating layer contains a phosphate ester represented by the following formula (I) as the lubricant, and the maximum value of the following characteristic X-ray intensities is at least 5 times the minimum value thereof: characteristic X-ray intensities obtained by radiating an electron beam which is accelerated to 20 kV and has a beam diameter of 1 μm or less onto plural positions of the heat-sensitive transfer sheet from the heat-resistant lubricating layer side of this sheet, and measuring the resultant characteristic X-rays originating from the K-line of the phosphorus element in the heat-resistant lubricating layer by means of an energy dispersive X-ray spectrometer:

Formula (I)

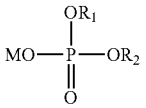

wherein M represents a hydrogen atom or a monovalent metal, $R_1$ represents a hydrogen atom, a monovalent metal, an alkyl group which may have a substituent, an alkenyl group which may have a substituent, or an aromatic group which may have a substituent, and $R_2$ represents an alkyl group which may have a substituent, an alkenyl group which may have a substituent, or an aromatic group which may have a substituent.

(2) The heat-sensitive transfer sheet according to item (1), wherein the phosphate ester has an alkyl group having 12 to 18 carbon atoms.

(3) The heat-sensitive transfer sheet according to item (1) or (2), wherein both of $R_1$ and $R_2$ represent —$CH_2CH_2$—O—$(CH_2CH_2O)_n$—$R_3$, wherein n is a number of 1 to 20, and $R_3$ is an alkyl or aryl group which may have a substituent.

(4) The heat-sensitive transfer sheet according to any one of items (1) to (3), wherein the maximum value of the characteristic X-ray intensities is at least 10 times the minimum value thereof.

(5) The heat-sensitive transfer sheet according to any one of items (1) to (4), wherein the heat-resistant lubricating layer contains a polyvalent metal salt of an alkylcarboxylic acid.

(6) The heat-sensitive transfer sheet according to any one of items (1) to (5), wherein the total coating mass of the phosphate ester in the heat-resistant lubricating layer is 5% or more and 25% or less of the total coating mass of the heat-resistant lubricating layer.

(7) The heat-sensitive transfer sheet according to any one of items (1) to (6), wherein the above-described heat-sensitive transfer sheet contains at least one dye represented by any one of following formulae (Y1) to (Y9) set forth below:

Formula (Y1)

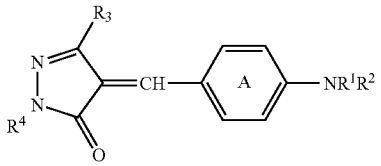

wherein the ring A represents a substituted or unsubstituted benzene ring; $R^1$ and $R^2$ each independently represent a hydrogen atom, a substituted or unsubstituted alkyl group, a substituted or unsubstituted alkenyl group or a substituted or unsubstituted aryl group; $R^3$ represents a hydrogen atom, a substituted or unsubstituted alkyl group, a substituted or unsubstituted amino group, a substituted or unsubstituted alkoxy group, a substituted or unsubstituted aryloxy group, a substituted or unsubstituted alkoxycarbonyl group, a substituted or unsubstituted aryloxycarbonyl group, a substituted or unsubstituted aryl group, or a substituted or unsubstituted carbamoyl group; and $R^4$ represents a substituted or unsubstituted alkyl group, or a substituted or unsubstituted aryl group;

Formula (Y2)

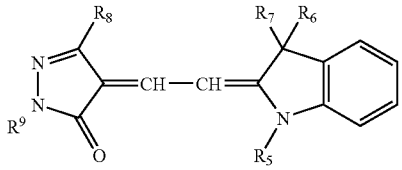

wherein $R^5$ represents a substituted or unsubstituted alkyl group, or a substituted or unsubstituted alkenyl group, $R^6$ and $R^7$ each independently represent a substituted or unsubstituted alkyl group, $R^8$ represents a substituted or unsubstituted alkyl group, a substituted or unsubstituted aryl group, a substituted or unsubstituted alkoxy group, or a substituted or unsubstituted amino group, and $R^9$ represents a substituted or unsubstituted alkyl group, or a substituted or unsubstituted aryl group;

Formula (Y3)

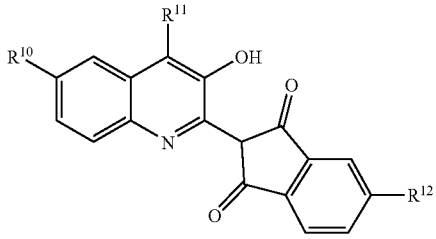

wherein $R^{10}$ represents a hydrogen atom, or a substituted or unsubstituted alkyl group, $R^{11}$ represents a hydrogen atom or a halogen atom, and $R^{12}$ represents a substituted or unsubstituted alkoxycarbonyl group, a substituted or unsubstituted aryloxycarbonyl group, or a substituted or unsubstituted carbamoyl group;

Formula (Y4)

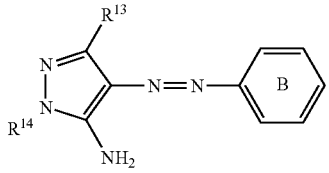

wherein the ring B represents a substituted or unsubstituted aryl group, or a substituted or unsubstituted aromatic heterocyclic group, $R^{13}$ represents a substituted or unsubstituted alkyl group, and $R^{14}$ represents a substituted or unsubstituted alkyl group, or a substituted or unsubstituted aryl group;

Formula (Y5)

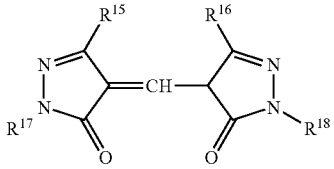

wherein $R^{15}$, $R^{16}$, $R^{17}$ and $R^{18}$ each independently represent a substituted or unsubstituted alkyl group or a substituted or unsubstituted aryl group;

Formula (Y6)

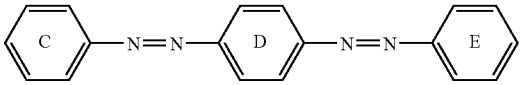

wherein the rings C, D and E each independently represent a substituted or unsubstituted benzene ring;

Formula (Y7)

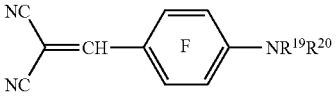

wherein the ring F represents a substituted or unsubstituted benzene ring; and $R^{19}$ and $R^{20}$ each independently represent a hydrogen atom, a substituted or unsubstituted alkyl group, a substituted or unsubstituted alkenyl group or a substituted or unsubstituted aryl group;

Formula (Y8)

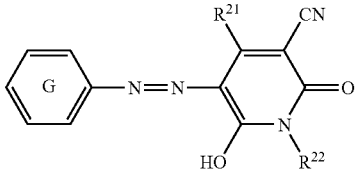

wherein the ring G represents a substituted or unsubstituted benzene ring; and $R^{21}$ and $R^{22}$ each independently represent a hydrogen atom or a substituted or unsubstituted alkyl group; and Formula (Y9)

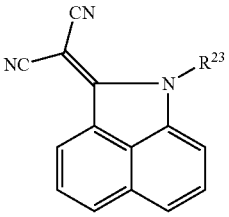

wherein $R^{23}$ represents a substituted or unsubstituted alkyl group or a substituted or unsubstituted alkenyl group.

(8) The heat-sensitive transfer sheet according to any one of items (1) to (7), wherein the above-described heat-sensitive transfer sheet contains at least one dye represented by any one of following formulae (M1) to (M8) set forth below:

Formula (M1)

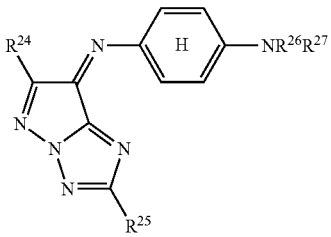

wherein the ring H represents a substituted or unsubstituted benzene ring or a substituted or unsubstituted pyridine ring; and $R^{24}$, $R^{25}$, $R^{26}$ and $R^{27}$ each independently represent a substituted or unsubstituted alkyl group, a substituted or unsubstituted alkenyl group or a substituted or unsubstituted aryl group;

Formula (M2)

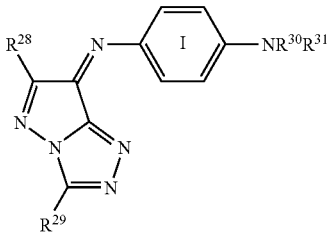

wherein the ring I represents a substituted or unsubstituted benzene ring or a substituted or unsubstituted pyridine ring; and $R^{28}$, $R^{29}$, $R^{30}$ and $R^{31}$ each independently represent a substituted or unsubstituted alkyl group, a substituted or unsubstituted alkenyl group or a substituted or unsubstituted aryl group;

Formula (M3)

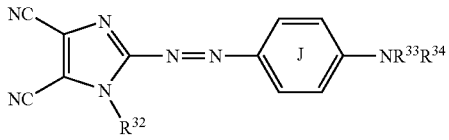

wherein the ring J represents a substituted or unsubstituted benzene ring, and $R^{32}$, $R^{33}$ and $R^{34}$ each independently represent a substituted or unsubstituted alkyl group, a substituted or unsubstituted alkenyl group or a substituted or unsubstituted aryl group;

Formula (M4)

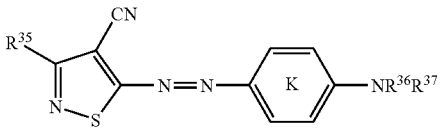

wherein the ring K represents a substituted or unsubstituted benzene ring, and $R^{35}$, $R^{36}$ and $R^{37}$ each independently represent a substituted or unsubstituted alkyl group, a substituted or unsubstituted alkenyl group or a substituted or unsubstituted aryl group, Formula (M5)

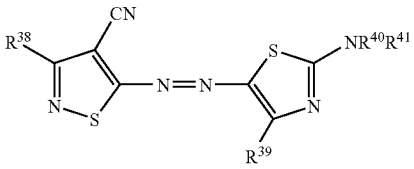

wherein $R^{38}$ and $R^{39}$ each independently represent a substituted or unsubstituted alkyl group, a substituted or unsubstituted aryl group, or a substituted or unsubstituted heterocyclic group, and $R^{40}$ and $R^{41}$ each independently represent a substituted or unsubstituted alkyl group, a substituted or unsubstituted alkenyl group, or a substituted or unsubstituted aryl group;

Formula (M6)

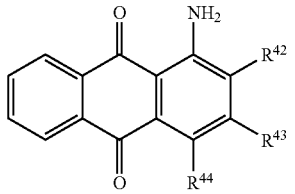

wherein $R^{42}$ is a substituted or unsubstituted aryloxy group, $R^{43}$ is a hydrogen atom, or a substituted or unsubstituted aryloxy group, and $R^{44}$ is a hydroxyl group, or a substituted or unsubstituted amino group;

Formula (M7)

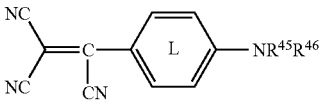

wherein the ring L represents a substituted or unsubstituted benzene ring; and $R^{45}$ and $R^{46}$ each independently represent a hydrogen atom, a substituted or unsubstituted alkyl group, a substituted or unsubstituted alkenyl group or a substituted or unsubstituted aryl group; and Formula (M8)

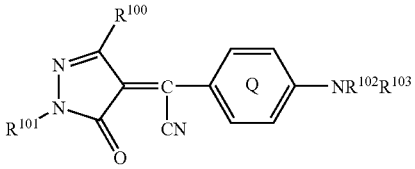

wherein the ring Q represents a substituted or unsubstituted benzene ring, $R^{100}$ represents a substituted or unsubstituted alkyl group, a substituted or unsubstituted aryl group, a substituted or unsubstituted alkoxy group, or a substituted or unsubstituted amino group, $R^{101}$ represents a substituted or unsubstituted alkyl group, or a substituted or unsubstituted aryl group, $R^{102}$ and $R^{103}$ each independently represent a hydrogen atom, a substituted or unsubstituted alkyl group, a substituted or unsubstituted alkenyl group, or a substituted or unsubstituted aryl group.

(9) The heat-sensitive transfer sheet according to any one of items (1) to (8), wherein the above-described heat-sensitive transfer sheet contains at least one dye represented by any one of following formulae (C1) to (C4) set forth below:

Formula (C1)

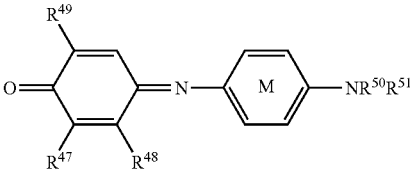

wherein the ring M represents a substituted or unsubstituted benzene ring, $R^{47}$ represents a hydrogen atom or a halogen atom, $R^{48}$ represents a substituted or unsubstituted alkyl group, $R^{49}$ represents a substituted or unsubstituted acylamino group or a substituted or unsubstituted alkoxycarbonylamino group, and $R^{50}$ and $R^{51}$ each independently represent a substituted or unsubstituted alkyl group, a substituted or unsubstituted alkenyl group or a substituted or unsubstituted aryl group;

Formula (C2)

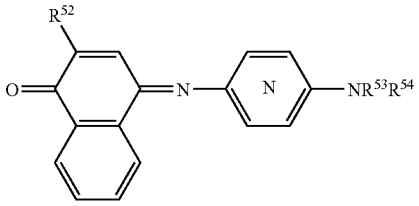

wherein the ring N represents a substituted or unsubstituted benzene ring, $R^{52}$ represents a hydrogen atom, a substituted or unsubstituted acylamino group, a substituted or unsubstituted alkoxycarbonyl group, or a substituted or unsubstituted carbamoyl group, and $R^{53}$ and $R^{54}$ each independently represent a substituted or unsubstituted alkyl group, a substituted or unsubstituted alkenyl group, or a substituted or unsubstituted aryl group;

Formula (C3)

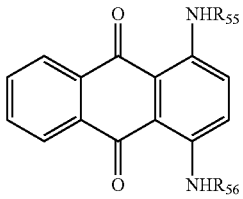

wherein $R^{55}$ and $R^{56}$ each independently represent an alkyl group, or a substituted or unsubstituted aryl group; and Formula (C4)

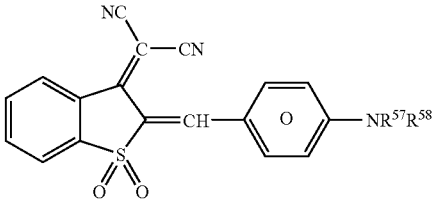

wherein the ring O represents a substituted or unsubstituted benzene ring, and $R^{57}$ and $R^{58}$ each independently represent a substituted or unsubstituted alkyl group, a substituted or unsubstituted alkenyl group, or a substituted or unsubstituted aryl group.

(10) An image formation method in which images are formed in a state that the heat-sensitive transfer sheet according to any one of items (1) to (9) is superposed upon a heat-sensitive transfer image-receiving sheet having at least one dye-receiving layer on a support.

(11) The image formation method according to item (10), wherein the heat-sensitive transfer image-receiving sheet has at least one dye-receiving layer on a support, and further has at least one heat insulation layer containing hollow polymer particles and a hydrophilic polymer between the dye-receiving layer and the support.

The present invention will be explained in detail below.

1) Heat-Sensitive Transfer Sheet (Structure of the Heat-Sensitive Transfer Sheet (Ink Sheet))

The ink sheet is used to transfer a colorant (dye) from the ink sheet to a heat-sensitive transfer image-receiving sheet in the following manner: when a thermally transferred image is formed, the ink sheet is put onto the heat-sensitive transfer image-receiving sheet and then the sheets are heated from the ink sheet side thereof by means of a thermal printer head or the like. The ink sheet of the invention has a base film, a dye layer (heat-transferable layer) formed over one surface of the base film and containing a heat-transferable dye and a resin, and a heat-resistant lubricating layer formed over the other surface of the base film and containing a lubricant and a resin. An easily-adhesive layer (primer layer) may be formed between the base film and the dye layer or between the base film and the heat-resistant lubricating layer.

In the ink sheet of the present invention, the heat-resistant lubricating layer contains a phosphate ester represented by the following formula (I) as a lubricant:

Formula (I)

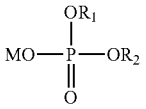

wherein M represents a hydrogen atom or a monovalent metal, $R_1$ represents a hydrogen atom, a monovalent metal, an alkyl group which may have a substituent, an alkenyl group which may have a substituent, or an aromatic group which may have a substituent, and $R_2$ represents an alkyl group which may have a substituent, an alkenyl group which may have a substituent, or an aromatic group which may have a substituent.

The phosphate ester used in the present invention is a compound wherein one out of three —OH groups connected with a phosphorous atom in a single molecule of phosphoric acid is esterified (monoester) or two out of the —OH groups are esterified (diester) so that the —OH group(s) not esterified remain(s). Therefore, at least one —OH group is connected with a phosphorous atom in the phosphate ester used in the present invention.

The phosphate ester is preferably a monoester or diester made from a phosphoric acid and a saturated or unsaturated alcohol having preferably 6 to 20 carbon atoms, more preferably 12 to 18 carbon atoms (such as stearyl alcohol or oleyl alcohol).

The phosphate ester is more preferably a monoester or diester made from a phosphoric acid and an alkylene oxide adduct of the same saturated or unsaturated alcohol as described above. The alkylene oxide is preferably ethylene oxide. The addition number thereof is preferably from 1 to 20, more preferably from 1 to 8. When an alkyl group is bonded to the alkylene oxide, the alkyl group preferably has 6 to 20 carbon atoms.

Also, the phosphate ester is preferably a monoester or diester made from a phosphoric acid and an aromatic alcohol having an alkyl group, such as an alkylphenol or alkylnaphthol (specifically, nonylphenol, dodecylphenol or xylenylphenol). The alkyl group bonded on the aromatic group which the aromatic alcohol has preferably has 6 to 20 carbon atoms.

The phosphate ester is more preferably a monoester or diester made from a phosphoric acid and an alkylene oxide adduct of the same aromatic alcohol as described above. The alkylene oxide is preferably ethylene oxide. The addition number thereof is preferably from 1 to 20, more preferably from 1 to 8. The alkyl group bonded on the aromatic ring which the aromatic alcohol has preferably 6 to 20 carbon atoms, more preferably 12 to 18 carbon atoms.

Of these compounds, even more preferred is a phosphate monoester or phosphate diester having an alkyl group having 12 to 18 carbon atoms.

The phosphate ester used in the present invention may be a monovalent metal salt thereof. A monovalent metal salt of a phosphate ester is a compound wherein one out of three —OH groups connected with a phosphorous atom in a single molecule of phosphoric acid is esterified (monoester) or two out of the —OH groups are esterified (diester), at least one hydrogen atom of the —OH group(s) not esterified is substituted by a monovalent metal atom. The monovalent metal is preferably an alkali metal, more preferably lithium, sodium or potassium, even more preferably sodium.

The above formula (I) is explained below. In the formula (I), M represents a hydrogen atom or a monovalent metal, $R_1$ represents a hydrogen atom, a monovalent metal, an alkyl group which may have a substituent, an alkenyl group which may have a substituent, or an aromatic group which may have a substituent, and $R_2$ represents an alkyl group which may have a substituent, an alkenyl group which may have a substituent, or an aromatic group which may have a substituent.

The monovalent metal is preferably the same as described above. The substituent which the alkyl, alkenyl or aromatic group as $R_1$ or $R_2$ may have may be any substituent, and is in particular preferably an alkyl group, an alkenyl group, an aromatic group, or $—O—(CH_2CH_2O)_n—R_3$, wherein n is a number of 1 or more, preferably from 1 to 20, more preferably from 1 to 8, and $R_3$ is an alkyl or aryl group which may have a substituent. The alkyl group has preferably 1 to 30 carbon atoms, more preferably 1 to 20 carbon atoms, and even more preferably 6 to 20 carbon atoms. The aryl group is preferably a phenyl group which may have a substituent, or a naphthyl group which may have a substituent, more preferably a phenyl group which may have a substituent. The substituent is preferably an alkyl group having 1 to 30 carbon atoms, preferably 1 to 20, more preferably 6 to 20, most preferably 8 to 18.

In the formula (I), $R_1$ and $R_2$ may be the same or different, $R_1$ and $R_2$ are preferably the same as each other. Preferably, $R_1$ and $R_2$ each represent an alkyl group which may have a substituent, an alkenyl group which may have a substituent, or an aromatic group which may have a substituent. Preferred is a compound wherein $R_2$ is preferably an alkyl group which may have a substituent, an alkenyl group which may have a substituent, or an aromatic group which may have a substituent; more preferred is a compound wherein $R_2$ is an alkyl group which may have a substituent; and most preferred is a compound wherein $R_2$ is $—O—(CH_2CH_2O)_n—R_3$.

In particular, $R_1$ and $R_2$ are each $—CH_2CH_2—O—(CH_2CH_2O)_n—R_3$ in view of heat resistance and lubricity.

The ink sheet of the present invention may comprise several kinds of the phosphate ester represented by the formula (I) or the monovalent metal salt thereof For example, the following may be used together: a monoester of a phosphate ester represented by the formula (I) wherein $R_1$ is a hydrogen atom or a monovalent metal, and $R_2$ is an alkyl group which may have a substituent, an alkenyl group which may have a substituent, or an aromatic group which may have a substituent; and a diester of a phosphate ester represented by the formula (I) wherein $R_1$ and $R_2$ are each an alkyl group which may have a substituent, an alkenyl group which may have a substituent, or an aromatic group which may have a substituent. When the structure of $R_1$ and that of $R_2$ have each an alkyl group in the formula (I), the carbon atom numbers of the alkyl group may be different from each other. In this case, $R_1$ and $R_2$ each represent preferably alkyl groups the carbon atom numbers of which are selected in the range of 6 to 20 and are different from each other. Further preferably $R_1$ and $R_2$ each represent alkyl groups the carbon atom numbers of which are selected in the range of 8 to 18 and are different from each other.

Many of these phosphate esters are commercially available. Examples thereof include NIKKOL DLP-10, NIKKOL DOP-8NV, NIKKOL DDP-2, NIKKOL DDP-4, NIKKOL DDP-6, NIKKOL DDP-8, and NIKKOL DDP-10, each of which is a trade name, manufactured by Nikko Chemicals Co., Ltd.

Other examples of the phosphate ester and the monovalent metal salt include dilauryl phosphate, dioleyl phosphate, distearyl phosphate, sodium di(polyoxyethylene nonyl ether) phosphate, di(polyoxyethylene dodecyl phenyl ether)phosphate, and sodium di(polyoxyethylene decyl phenyl ether) phosphate.

In the invention, the heat-resistant lubricating layer may contain other additives such as some other lubricant, a plasticizer, a stabilizer, a bulking agent, and a filler for removing a material adhering to a head.

Examples of the lubricant include fluorides such as calcium fluoride, and graphite fluoride; sulfides such as molybdenum disulfide, tungsten disulfide, and iron sulfide; oxides such as silica, colloidal silica, lead oxide, alumina, and molybdenum oxide; solid lubricants each made of an inorganic compound such as graphite, mica, boron nitride, or a clay (such as talc, kaolin, or acid white clay); organic resins such as fluorine-contained resin and silicone resin; silicone oils; phosphate triesters; metal soaps such as polyvalent metal salts of an alkylcarboxylic acid (such as zinc stearate and lithium stearate), and polyvalent metal salts of a phosphate ester (such as zinc stearyl phosphate, and calcium polyoxyethylene tridecyl ether phosphate); various waxes such as polyethylene wax, and paraffin wax; and surfactants such as anionic surfactants, cationic surfactants, amphoteric surfactants, nonionic surfactants, and fluorine-contained surfactants.

Of these additives that may be used together, preferred are talc, kaolin, phosphate triesters, polyvalent metal salts of an alkylcarboxylic acid and polyvalent metal salts of a phosphate ester. The alkylcarboxylic acid polyvalent metal salts are preferably polyvalent metal salts of an alkylcarboxylic acid having 1 to 30 carbon atoms, more preferably such salts having 8 to 20 carbon atoms. Most preferred is zinc stearate.

Some ester surfactants have acid groups. As a result, when a large calorie is given thereto from a thermal head, the esters may decompose and further the pH of the backside layer may be lowered to corrode and abrade the thermal head largely. Examples of a method to be adopted against this problem include a method of using a neutralized ester surfactant, and a method of using a neutralizing agent such as magnesium hydroxide.

Other examples of the additives include higher aliphatic alcohols, organopolysiloxanes, and organic carboxylic acids.

(Characteristic X-Ray Intensity)

The method for measuring characteristic X-ray intensities is in principle a method of measuring intensities of the characteristic X-ray obtained by exciting atoms in a sample by irradiation with an electron beam. The method will be described in detail hereinafter.

(Electron Beam Radiation)

The electron beam to be radiated needs to receive an accelerating voltage of 20 kV and have a beam diameter of 1 μm or less in order to keep a necessary resolution certainly. Even if the accelerating voltage is made higher or lower, the intensity of the characteristic X-ray originating from the phosphorus element in a sample decreases and simultaneously base line noises increase. As a result, the intensity cannot be precisely measured. By the radiation of the beam, the electrons in the sample are scattered so that the spatial resolution of the X-ray image becomes larger than the beam diameter. The scattering of the electrons is varied in accordance with the kind of the element to be measured; in the invention, the scattering distance in the depth direction is about 5 μm and that in the width direction is about 10 μm at an accelerating voltage of 20 kV. When the beam diameter is 1 μm or less, no difference in the spatial resolution is generated. In order to make the characteristic X-ray intensity to be measured large, the electric current amount is usually increased. However, the increase in the beam diameter simultaneously increases. A field emission electron gun is used as a source for the electrons since a larger electric current amount can be obtained and an increase in the beam diameter resulting from an increase in the electric current amount is small. The electric current amount needs to be kept at a constant value since the amount is in proportion to the characteristic X-ray intensity.

(Characteristic X-Ray Measurement)

The method for the measurement is classified to wavelength dispersive X-ray spectrometry (abbreviated to "WDS" or "WDX") and energy dispersive X-ray spectrometry (abbreviated to "EDS" or "EDX"). Each of the spectrometries is a characteristic measuring method. It is necessary in the invention to use energy dispersive X-ray spectrometry since the spectrometry is excellent for analysis of microscopic areas and the analysis period is short. In the invention, the measurement at a single spot can be attained in a period of about 1 to 3 minutes. The characteristic X-ray of any phosphorus element include three species of the $K\alpha1$ line (2.014 keV), the $K\alpha2$ line (2.013 keV), and the $K\beta1$ line (2.139 keV); however, in energy dispersive X-ray spectrometry, the individual rays overlap with each other so that the rays are detected as a single peak. For this reason, this is named the K-line. The intensity of the K-line of phosphorus is the intensity of the characteristic X-ray originating from the K-line of the phosphorus element in the invention. In the case of measuring the intensities of the characteristic X-ray originating from the phosphorus element at plural spots in a single sample, the measuring periods for the individual spots needs to be made equal to each other as well as the electric current amounts.

The measurement is preferably made by means of a device wherein a scanning electron microscope (abbreviated to an "SEM") is equipped with an energy dispersive X-ray spectrometer (abbreviated to an "SEM-EDX" or "SEM-EDS") since only a single electron beam source can be used for the microscope and the spectrometer and the positions of the measured spots can be checked.

Specifically, a sample is first measured with an SEM so as to check whether or not the focus of the electron beam is sufficiently adjusted. After a sufficient adjustment of the focus, the whole of the same area as measured with the SEM is scanned and measured with an EDX (energy dispersive X-ray spectrometer) so as to carry out element mapping of phosphorus. The element mapping with the EDX is a method of: measuring the intensity of the characteristic X-ray from the element at each spot in a short period while an electron beam is scanned; and then mapping the resultant characteristic X-ray intensities. From the intensity-mapped image, spots where the ratio of the amount of the contained phosphorus element is large and spots where the ratio is small can be selected. An electron beam is not scanned but fixed onto each of the selected spots to measure the intensity of the characteristic X-ray originating from the K-line of the phosphorus element. In this way, the intensities of the characteristic X-ray can be precisely measured. Usually, for a single sample, from an area 100 μm square, spots where the ratio of the amount of the contained phosphorus element is large and spots where the ratio is small are selected by a number of 10 to 20 in total, and the selected spots are measured.

(Preparation of a Sample for Measurement)

When an electron beam is radiated to a sample so that the sample is electrified, the electron beam is fluctuated by an electric field generated by the electrification and further the electric current value of the electron beam is varied. Thus, a precise measurement cannot be attained. In order to prevent such electrification, it is necessary to cover the sample surface with an electroconductive thin film. The electroconductive thin film is preferably a coating formed by sputtering carbon (C) into a thickness of 20 to 35 nm.

Such preparation is described in more detail in "Hyoumen Bunseki Gizyutsu Sensyo (Surface Analyzing Technique Selected-Book) Electronic Probe/Microanalyzer" edited by the Surface Science Society of Japan and published by Maruzen Co., Ltd., 1998, and "EMPA Electron Probe Microanalyzer" written by Shiro Kinouchi and published by Gijutusyoin, 2001.

(Intensity of the Characteristic X-Ray Originating from the K-Line of the Phosphorus Element in the Heat-Resistant Lubricating Layer)

In the invention, it is essential that about the intensities of the characteristic X-ray originating from the K-line of the phosphorus element in the heat-resistant lubricating layer which are measured at the individual spots by the above-mentioned method, the maximum value thereof is at least 5 times larger the minimum value thereof. The maximum is preferably at least 10 times larger the minimum value. As this value is larger, molecules of the phosphate ester are more localized, without being evenly distributed, in the heat-resistant lubricating layer. In the invention, the phosphate ester needs to be localized in the heat-resistant lubricating layer. If the localization of the phosphate ester is insufficient, the lubricity of the heat-resistant lubricating layer is improved by increasing the amount of the contained phosphate ester; however, a fall in the transfer density is simultaneously generated. On the other hand, by localizing the phosphate ester, a fall in the transfer density can be restrained while the lubricity can be improved. This advantageous effect can be more largely produced in higher-speed print.

The upper limit of the magnifying power is not particularly limited, and is preferably 50 times, more preferably 40 times.

In the invention, it is essential that the phosphate ester represented by the formula (I) is incorporated into the heat-resistant lubricating layer, and further the maximum value of the intensities of the characteristic X-ray originating from the K-line of the phosphorus element in the heat-resistant lubricating layer is set into a value at least 5 times larger than the minimum value thereof, as described above. The phosphate ester or the salt is once dissolved in the step of producing a coating solution therefor; however, after the solution is painted, the distribution of the phosphate ester is localized in the heat-resistant lubricating layer. The structure of the heat-resistant lubricating layer wherein the phosphate ester is localized is broken out when the temperature and/or the humidity at which the heat-resistant lubricating layer is allowed to stand still is/are high. Thus, the advantageous effects of the invention cannot be exhibited. The temperature and humidity environment in which the heat-sensitive transfer sheet is allowed to stand still is varied in accordance with the kind and the amount of the used phosphate ester, a resin used together, and others. At 60° C. and a low humidity, the sheet is preferably allowed to stand still for one day or less; at 60° C. and a high humidity, preferably for 4 hours or less; at 40° C. and a low humidity, preferably for 30 days or less; and at 40° C. and a high humidity, preferably for 4 days or less. Of phosphate esters represented by the formula (I), a phosphate ester having an alkyl group having 12 to 18 carbon atoms is preferred since an allowable range of the environment temperature can be made wide.

In the case of incorporating, into the heat-resistant lubricating layer, particles appropriate in size which are made of a phosphate ester polyvalent metal salt, which is hardly dissolved in the solvent used in the production of the coating solution (the salt being, for example, zinc stearylphosphate), it is possible in principle that the maximum value of the intensities of the characteristic X-ray originating from the K-line of the phosphorus element in the heat-resistant lubricating layer is at least 5 times the minimum value thereof. However, the phosphate ester polyvalent metal salt results in insufficient lubricity and transfer density, so that the advantageous effects of the invention are not produced. On the other hand, it is possible to use such a phosphate ester polyvalent metal salt together with the phosphate ester represented by the formula (I) in order to give releasability to the heat-resistant lubricating layer. The ratio of the coating mass of the phosphate ester polyvalent metal salt contained in this case is preferably 10% or less, more preferably 5% or less of the total coating mass of the entire phosphate ester in the heat-resistant lubricating layer.

The ratio of the total coating mass of the phosphate ester represented by the formula (I) in the heat-resistant lubricating layer is preferably 2% or more and 25% or less, more preferably 5% or more and 20% or less of the total coating mass of the heat-resistant lubricating layer. Some other phosphate ester may be used together. The ratio of the total coating mass of the entire phosphate esters contained in this case is preferably 3% or more and 30% or less, more preferably 5% or more and 25% or less of the total coating mass of the heat-resistant lubricating layer.

The heat-resistant lubricating layer needs to contain a resin. The resin may be a highly heat-resistant known resin. Examples thereof include cellulose resins such as ethylcellulose, hydroxycellulose, hydroxypropylcellulose, methylcellulose, cellulose acetate, cellulose acetate butyrate, cellulose acetate propionate, and nitrocellulose; vinyl resins such as polyvinyl alcohol resin, polyvinyl acetate resin, polyvinyl butyral, polyvinyl acetal, polyvinyl acetoacetal resin, vinyl chloride-vinyl acetal copolymer and polyvinyl pyrrolidone; (meth)acrylic resins such as methyl polymethacrylate, ethyl polyacrylate, polyacrylamide, and acrylonitrile-styrene copolymer; other resins such as polyamide resin, polyimide resin, polyamideimide resin, polyvinyl toluene resin, coumarone indene resin, polyester resin, polyurethane resin, polyether resin, polybutadiene resin, polycarbonate resin, chlorinated polyolefin resin, fluorine-contained resin, epoxy resin, phenol resin, silicone resin, silicone-modified or fluorinemodified urethane, and other natural or synthetic resins. These may be used alone or in a mixture form.

The resin may be crosslinked by radiating ultraviolet rays or an electron beam thereto in order to make the heat resistance high. A crosslinking agent may be used to crosslink the resin by aid of heating. At this time, a catalyst may be added thereto. Examples of the crosslinking agent include isocyanate based agents (such as polyisocyanate, and a cyclic trimer of polyisocyanate), and metal-containing agents (such as titanium tetrabutyrate, zirconium tetrabutyrate, and aluminum triisopropionate). Examples of the resin with which these crosslinking agents are each caused to react include polyvinyl acetal, polyvinyl butyral, polyester polyol, alkyd polyol, and silicone compounds containing, in side chains thereof, amino groups.

It is known that when the heat-resistant lubricating layer is formed by painting and then the layer is put into a high-temperature environment or a high-temperature and high-humidity environment, the reaction between the resin and the crosslinking agent is promoted; however, it is necessary to select conditions for not breaking out the phosphate ester localized structure in the heat-resistant lubricating layer in the invention. Under the conditions, an appropriate combination of the resin and the crosslinking agent may be selected in order to promote the crosslinking reaction sufficiently. Under conditions of 60° C. and a low humidity, preferred is a combination of a resin and a crosslinking agent capable of promoting the crosslinking reaction sufficiently within one day. The resin is preferably polyvinyl acetal, polyvinyl butyral or polyester polyol, and the crosslinking agent is preferably an isocyanate based crosslinking agent. When a polyisocyanate based crosslinking agent is used to attain the crosslinking, the advance of the crosslinking reaction can be inspected by detecting remaining isocyanate groups through IR spectral analysis. The wording "promote the crosslinking reaction sufficiently" means that the ratio between the intensity of the IR spectrum peak originating from the remaining isocyanate groups in the heat-resistant lubricating layer immediately after being formed by painting and dried and the intensity of the IR spectrum peak originating from the remaining isocyanate groups in the layer after the crosslinking reaction (specifically, the ratio of the latter intensity to the former intensity) is 20% or less, preferably 10% or less, most preferably 5% or less.

The heat-resistant lubricating layer is formed by adding the essential components and optional additives to the binder, examples of which have been described above, dissolving or dispersing the resultant into a solvent to prepare a coating solution, and then painting the coating solution by a known method such as gravure coating, roll coating, blade coating or wire bar coating. The film thickness of the heat-resistant lubricating layer is preferably from 0.1 to 3 μm, more preferably from 0.2 to 2 μm.

(Base Film)

As the base film, any one of known materials can be used, so far as such the material has both a heat resistance and a mechanical strength necessary to the requirements for the support. Specific examples of preferable base films include thin papers such as a glassine paper, a condenser paper, and a paraffin paper; polyesters having high resistance to heat such as polyethyleneterephthalate, polyethylenenaphthalate, polybuyleneterephthalate, polyphenylene sulfide, polyetherketone, and polyethersulfone; stretched or unstretched films of plastics such as polypropylene, polycarbonate, cellulose acetate, polyethylene derivatives, poly(vinyl chloride), poly (vinylidene chloride), polystyrene, polyamide, polyimide, polymethylpentene, and ionomers; and laminates of these materials. Of these materials, polyester films are especially preferred. Stretched polyester films are most preferred. A thickness of the base film can be properly determined in accordance with the material of the base film so that the mechanical strength and the heat resistance become optimum. Specifically, it is preferred to use a support having a thickness of about 1 μm to about 30 μm, more preferably from about 1 μm to 20 μm, and further preferably from about 3 μm to about 10 μm.

The dye layer containing a heat-transferable dye (hereinafter also referred to as the heat-sensitive transfer layer or the heat transfer layer) can be formed by painting a dye ink.

(Dye Layer)

In the dye layer in the invention, preferably, dye (sub)layers in individual colors of yellow, magenta and cyan, and an optional dye (sub)layer in black are repeatedly painted onto a single support in area order in such a manner that the colors are divided from each other. An example of the dye layer is an embodiment wherein dye (sub)layers in individual colors of yellow, magenta and cyan are painted onto a single support along the long axial direction thereof in area order, correspondingly to the area of the recording surface of the above-mentioned heat-sensitive transfer image-receiving sheet, in such a manner that the colors are divided from each other. Another example thereof is an embodiment wherein not only the three (sub)layers but also a dye (sub)layer in black and/or a transferable protective layer are painted in such a manner that these (sub)layers are divided from each other. This embodiment is preferred.

In the case of adopting such an embodiment, it is preferred to give marks to the heat-sensitive transfer sheet in order to inform the printer about starting point of the individual colors. Such painting repeated in area order makes it possible that a single heat-sensitive transfer sheet is used to form an image on the basis of transfer of dyes and further laminate a protective layer on the image.

In the invention, however, the manner in which the dye layer is formed is not limited to the above-mentioned manners. A sublimation heat-transferable ink layer and a heat-melt transferable ink layer may be together formed. A dye in a color other than yellow, magenta, cyan and black is formed, or other modifications may be made. The form of the heat-sensitive transfer sheet including the dye layer may be a longitudinal form, or a one-piece form.

The dye layer may have a mono-layered structure or a multi-layered structure. In the case of the multi-layered structure, the individual layers constituting the dye layer may be the same or different in composition.

(Dye Ink)

The dye layer contains at least a sublimation type dye and a binder resin. It is a preferable embodiment of the present invention that the ink may contains organic or inorganic finely divided powder, waxes, silicone resins, and fluorine-containing organic compounds, in accordance with necessity.

Each dye in the dye layer is preferably contained in an amount of 10 to 90 mass % of the dye layer, preferably in that of 20 to 80 mass % thereof.

The coating of the dye layer (i.e., the painting of a coating solution for the dye layer) is performed by an ordinary method such as roll coating, bar coating, gravure coating, or gravure reverse coating. The coating amount of the dye layer is preferably from 0.1 to 2.0 g/m$^2$, more preferably from 0.2 to 1.2 g/m$^2$ (the amount is a numerical value converted to the solid content in the layer; any coating amount in the following description is a numerical value converted to the solid content unless otherwise specified). The film thickness of the dye layer is preferably from 0.1 to 2.0 μm, more preferably from 0.2 to 1.2 μm.

(The Dyes)

The dyes contained in the dye layer in the present invention must be the dyes are able to diffuse by heat and able to be incorporated in a heat-sensitive transfer sheet, and able to transfer by heat from the heat-sensitive transfer sheet to an image-receiving sheet. As the dyes that are used for the heat-sensitive transfer sheet, ordinarily used dyes or known dyes can be effectively used.

Preferable examples of the dyes that is used in the present invention include diarylmethane-series dyes, triarylmethane-series dyes, thiazole-series dyes, methine-series dyes such as merocyanine; azomethine-series dyes typically exemplified by indoaniline, acetophenoneazomethine, pyrazoloazomethine, imidazole azomethine, imidazo azomethine, and pyridone azomethine; xanthene-series dyes; oxazine-series dyes; cyanomethylene-series dyes typically exemplified by dicyanostyrene, and tricyanostyrene; thiazine-series dyes; azine-series dyes; acridine-series dyes; benzene azo-series dyes; azo-series dyes such as pyridone azo, thiophene azo, isothiazole azo, pyrrol azo, pyralazo, imidazole azo, thiadiazole azo, triazole azo, and disazo; spiropyran-series dyes; indolinospiropyran-series dyes; fluoran-series dyes; rhodaminelactam-series dyes; naphthoquinone-series dyes; anthraquinone-series dyes; and quinophthalon-series dyes.

Specific examples of the yellow dyes include Disperse Yellow 231, Disperse Yellow 201 and Solvent Yellow 93. Specific examples of the magenta dyes include Disperse Violet 26, Disperse Red 60, and Solvent Red 19. Specific examples of the cyan dyes include Solvent Blue 63, Solvent Blue 36, Disperse Blue 354 and Disperse Blue 35. As a matter of course, it is also possible to use suitable dyes other than these dyes as exemplified above.

Further, dyes each having a different hue from each other as described above may be arbitrarily combined together. For instance, a black hue can be obtained from a combination of dyes.

In the present invention, dyes represented by any one of formulae (Y1) to (Y9), formulae (M1) to (M8), and formulae (C1) to (C4) set forth below are preferably used.

These dyes are explained in detail below.

Formula (Y1)

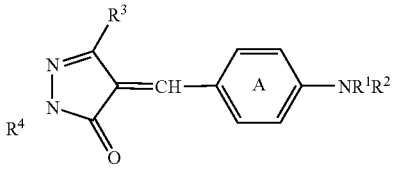

In the formula (Y1), the ring A represents a substituted or unsubstituted benzene ring; $R^1$ and $R^2$ each independently represent a hydrogen atom, a substituted or unsubstituted alkyl group, a substituted or unsubstituted alkenyl group or a substituted or unsubstituted aryl group; $R^3$ represents a hydrogen atom, a substituted or unsubstituted alkyl group, a substituted or unsubstituted amino group, a substituted or unsubstituted alkoxy group, a substituted or unsubstituted aryloxy group, a substituted or unsubstituted alkoxycarbonyl group, a substituted or unsubstituted aryloxycarbonyl group, a substituted or unsubstituted aryl group, or a substituted or unsubstituted carbamoyl group; and $R^4$ represents a substituted or unsubstituted alkyl group, or a substituted or unsubstituted aryl group.

Examples of the substituent by which each of the ring A and the groups $R^1$, $R^2$, $R^3$ and $R^4$ may be substituted include halogen atoms, unsaturated aliphatic groups, aryl groups, heterocyclic groups, aliphatic oxy groups (typically, alkoxy groups), acyloxy groups, carbamoyloxy groups, aliphatic oxycarbonyloxy groups (typically, alkoxycarbonyloxy groups), aryloxycarbonyl groups, amino groups, acylamino groups, aminocarbonylamino groups, aliphatic oxycarbonylamino groups (typically, alkoxycarbonylamino groups), sulfamoylamino groups, aliphatic (typically, alkyl) or arylsulfonylamino groups, aliphatic thio groups (typically, alkylthio groups), sulfamoyl groups, aliphatic (typically, alkyl) or arylsulfinyl groups, aliphatic (typically, alkyl) or arylsulfonyl groups, acyl groups, aryloxycarbonyl groups, aliphatic oxycarbonyl groups (typically, alkoxycarbonyl groups), carbamoyl groups, aryl or heterocyclic azo groups, imide groups, a hydroxy group, a cyano group, a nitro group, a sulfo group, and a carboxyl group.

These groups may each further have a substituent. Examples of the substituent include the above-mentioned substituents.

Examples of a preferred combination of the ring A and groups $R^1$ to $R^4$ in the dye represented by the formula (Y1) include combinations wherein the ring A is a substituted or unsubstituted benzene ring, $R^1$ is a substituted or unsubstituted alkyl group having 1 to 8 carbon atoms, an allyl group, or a substituted or unsubstituted aryl group having 6 to 10 carbon atoms, $R^2$ is a substituted or unsubstituted alkyl group having 1 to 8 carbon atoms, an allyl group, or a substituted or unsubstituted aryl group having 6 to 10 carbon atoms, $R^3$ is a substituted or unsubstituted amino group, or a substituted or unsubstituted alkoxy group, and $R^4$ is a substituted or unsubstituted alkyl group having 1 to 8 carbon atoms, or a substituted or unsubstituted aryl group having 6 to 10 carbon atoms.

In more preferred combinations thereof, the ring A is a substituted or unsubstituted benzene ring, $R^1$ is a substituted or unsubstituted alkyl group having 1 to 6 carbon atoms, an allyl group, or a substituted or unsubstituted phenyl group, $R^2$ is a substituted or unsubstituted alkyl group having 1 to 6 carbon atoms, an allyl group, or a substituted or unsubstituted phenyl group, $R^3$ is a substituted or unsubstituted amino group, or a substituted or unsubstituted alkoxy group, and $R^4$ is a substituted or unsubstituted alkyl group having 1 to 6 carbon atoms, or a substituted or unsubstituted phenyl group.

In the most preferred combinations thereof, the ring A is a benzene ring substituted by a methyl group or a chlorine atom, or an unsubstituted benzene ring, $R^1$ is a substituted or unsubstituted alkyl group having 1 to 4 carbon atoms, or an allyl group, $R^2$ is a substituted or unsubstituted alkyl group having 1 to 4 carbon atoms, or an allyl group, $R^3$ is a substituted or unsubstituted amino group, or a substituted or unsubstituted alkoxy group, and $R^4$ is a substituted or unsubstituted phenyl group.

Formula (Y2)

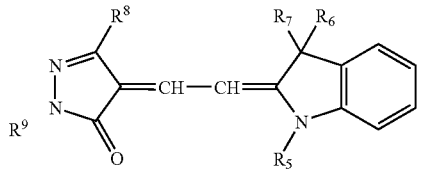

In the formula (Y2), $R^5$ represents a substituted or unsubstituted alkyl group, or a substituted or unsubstituted alkenyl group, $R^6$ and $R^7$ each independently represent a substituted or unsubstituted alkyl group, $R^8$ represents a substituted or unsubstituted alkyl group, a substituted or unsubstituted aryl group, a substituted or unsubstituted alkoxy group, or a substituted or unsubstituted amino group, and $R^9$ represents a substituted or unsubstituted alkyl group, or a substituted or unsubstituted aryl group.

Each of the groups represented by $R^5$, $R^6$, $R^7$, $R^8$ and $R^9$ may further have a substituent. Examples of a substituent by which each of the groups of $R^5$, $R^6$, $R^7$, $R^8$ and $R^9$ may be substituted include the same substituents as each of the ring A and the substituents $R^1$ to $R^4$ in the formula (Y1) may have.

Examples of a preferred combination of the groups $R^5$ to $R^9$ in the dye represented by the formula (Y2) include combinations wherein $R^5$ is a substituted or unsubstituted alkyl group having 1 to 8 carbon atoms, or an allyl group, $R^6$ is a substituted or unsubstituted alkyl group having 1 to 8 carbon atoms, $R^7$ is a substituted or unsubstituted alkyl group having 1 to 8 carbon atoms, $R^8$ is a substituted or unsubstituted alkyl group having 1 to 8 carbon atoms, a substituted or unsubstituted aryl group having 6 to 10 carbon atoms, a substituted or unsubstituted alkoxy group having 1 to 8 carbon atoms, or a substituted or unsubstituted amino group, and $R^9$ represents a substituted or unsubstituted alkyl group having 1 to 8 carbon atoms, or a substituted or unsubstituted aryl group having 6 to 10 carbon atoms.

In more preferred combinations thereof, $R^5$ is a substituted or unsubstituted alkyl group having 1 to 6 carbon atoms, or an allyl group, $R^6$ is a substituted or unsubstituted alkyl group having 1 to 6 carbon atoms, $R^7$ is a substituted or unsubstituted alkyl group having 1 to 6 carbon atoms, $R^8$ is a substituted or unsubstituted alkyl group having 1 to 6 carbon atoms, a substituted or unsubstituted phenyl group, a substituted or unsubstituted alkoxy group having 1 to 6 carbon atoms, or a substituted or unsubstituted amino group, and $R^9$ represents a substituted or unsubstituted alkyl group having 1 to 6 carbon atoms, or a substituted or unsubstituted phenyl group.

In the most preferred combinations thereof, $R^5$ is an unsubstituted alkyl group having 1 to 4 carbon atoms, $R^6$ is an unsubstituted alkyl group having 1 to 4 carbon atoms, $R^7$ is an unsubstituted alkyl group having 1 to 4 carbon atoms, $R^8$ is a methoxy, ethoxy, or dimethylamino group, and $R^9$ is an unsubstituted phenyl group.

Formula (Y3)

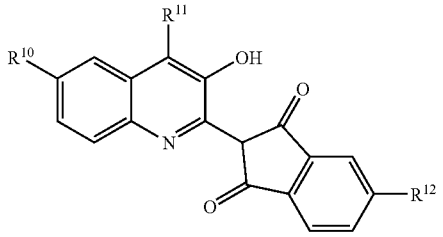

In the formula (Y3), $R^{10}$ represents a hydrogen atom, or a substituted or unsubstituted alkyl group, $R^{11}$ represents a hydrogen atom or a halogen atom, and $R^{12}$ represents a substituted or unsubstituted alkoxycarbonyl group, a substituted or unsubstituted aryloxycarbonyl group, or a substituted or unsubstituted carbamoyl group.

Each of the groups represented by $R^{10}$ and $R^{12}$ may further have a substituent. Examples of a substituent by which each of the groups of $R^{10}$ and $R^{12}$ may be substituted include the same substituents as each of the ring A and the substituents $R^1$ to $R^4$ in the formula (Y1) may have.

Examples of a preferred combination of the groups $R^{10}$ to $R^{12}$ in the dye represented by the formula (Y3) include combinations wherein $R^{10}$ is a hydrogen atom or a substituted or unsubstituted alkyl group having 1 to 8 carbon atoms, $R^{11}$ is a hydrogen atom, a chlorine atom, or a bromine atom, and $R^{12}$ is an unsubstituted alkoxycarbonyl group, an unsubstituted aryloxycarbonyl group, or a substituted or unsubstituted carbamoyl group.

In more preferred combinations thereof, $R^{10}$ is a hydrogen atom or a substituted or unsubstituted alkyl group having 1 to 6 carbon atoms, $R^{11}$ is a hydrogen atom or a bromine atom, and $R^{12}$ is an unsubstituted alkoxycarbonyl group having 2 to 10 carbon atoms, or a dialkylcarbamoyl group having 2 to 12 carbon atoms.

In the most preferred combinations thereof, $R^{10}$ is a hydrogen atom or an unsubstituted alkyl group having 2 to 4 carbon atoms, $R^{11}$ is a hydrogen atom, and $R^{12}$ is a dialkylcarbamoyl group having 2 to 10 carbon atoms.

Formula (Y4)

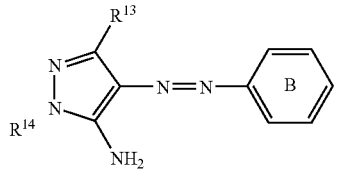

In the formula (Y4), the ring B represents a substituted or unsubstituted aryl group, or a substituted or unsubstituted aromatic heterocyclic group, $R^{13}$ represents a substituted or unsubstituted alkyl group, and $R^{14}$ represents a substituted or unsubstituted alkyl group, or a substituted or unsubstituted aryl group.

Each of the ring B and the groups represented by $R^{13}$ and $R^{14}$ may further have a substituent. Examples of a substituent by which each of the ring B and the groups of $R^{13}$ and $R^{14}$ may be substituted include the same substituents as each of the ring A and the substituents $R^1$ to $R^4$ in the formula (Y1) may have.

Examples of a preferred combination of the ring B and the groups $R^{13}$ and $R^{14}$ in the dye represented by the formula (Y4) include combinations wherein the ring B is a substituted or unsubstituted aryl group having 6 to 10 carbon atoms, a substituted or unsubstituted pyrazolyl group, or a substituted or unsubstituted thiadiazolyl group, $R^{13}$ is a substituted or unsubstituted alkyl group having 1 to 8 carbon atoms, and $R^{14}$ is a substituted or unsubstituted alkyl group having 1 to 8 carbon atoms, or a substituted or unsubstituted aryl group having 6 to 10 carbon atoms.

In more preferred combinations thereof, the ring B is a substituted or unsubstituted phenyl group, or a substituted or unsubstituted 1,3,4-thiadiazolyl group, $R^{13}$ is a substituted or unsubstituted alkyl group having 1 to 6 carbon atoms, and $R^{14}$ is a substituted or unsubstituted alkyl group having 1 to 6 carbon atoms, or a substituted or unsubstituted phenyl group.

In the most preferred combinations thereof, the ring B is a 4-nitrophenyl group, or a 1,3,4-thiadiazolyl group having a thioalkyl group having 1 to 6 carbon atoms as a substituent, $R^{13}$ is an unsubstituted alkyl group having 1 to 4 carbon atoms, and $R^{14}$ is an unsubstituted alkyl group having 1 to 4 carbon atoms, or a substituted or unsubstituted phenyl group.

Formula (Y5)

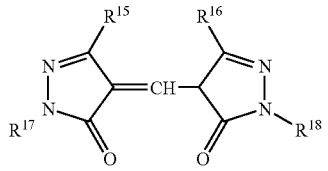

In the formula (Y5), $R^{15}$, $R^{16}$, $R^{17}$ and $R^{18}$ each independently represent a substituted or unsubstituted alkyl group or a substituted or unsubstituted aryl group.

Each of the groups represented by $R^{15}$, $R^{16}$, $R^{17}$ and $R^{18}$ may further have a substituent. Examples of a substituent by which each of the groups of $R^{15}$, $R^{16}$, $R^{17}$ and $R^{18}$ may be substituted include the same substituents as each of the ring A and the substituents $R^1$ to $R^4$ in the formula (Y1) may have.

Examples of a preferred combination of the substituents $R^{15}$ to $R^{18}$ in a dye represented by the formula (Y5) include combinations wherein $R^{15}$ is a substituted or unsubstituted alkyl group having 1 to 8 carbon atoms or a substituted or unsubstituted aryl group having 6 to 10 carbon atoms, $R^{16}$ is a substituted or unsubstituted alkyl group having 1 to 8 carbon atoms or a substituted or unsubstituted aryl group having 6 to 10 carbon atoms, $R^{17}$ is a substituted or unsubstituted alkyl group having 1 to 8 carbon atoms or a substituted or unsubstituted aryl group having 6 to 10 carbon atoms, and $R^{18}$ is a substituted or unsubstituted alkyl group having 1 to 8 carbon atoms or a substituted or unsubstituted aryl group having 6 to 10 carbon atoms.

In more preferred combinations of the substituents $R^{15}$ to $R^{18}$, $R^{15}$ is a substituted or unsubstituted alkyl group having 1 to 6 carbon atoms, $R^{16}$ is a substituted or unsubstituted alkyl group having 1 to 6 carbon atoms, $R^{17}$ is a substituted or unsubstituted phenyl group, and $R^{18}$ is a substituted or unsubstituted phenyl group.

In the most preferred combinations thereof, $R^{15}$ is a substituted or unsubstituted alkyl group having 1 to 4 carbon atoms, $R^{16}$ is a substituted or unsubstituted alkyl group having 1 to 4 carbon atoms, $R^{17}$ is an unsubstituted phenyl group, and $R^{18}$ is an unsubstituted phenyl group.

Formula (Y6)

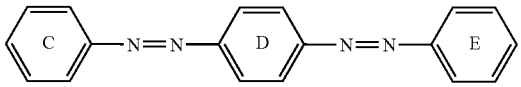

In the formula (Y6), the rings C, D and E each independently represent a substituted or unsubstituted benzene ring.

Each of the rings C, D and E may further have a substituent. Examples of a substituent by which each of the rings C, D and E may be substituted include the same substituents as each of the ring A and the substituents $R^1$ to $R^4$ in the formula (Y1) may have.

The ring C is preferably a benzene ring substituted by an alkyl group having 1 to 8 carbon atoms, a benzene ring substituted by an alkoxy group having 1 to 8 carbon atoms, a benzene ring substituted by a hydroxyl group, or an unsubstituted benzene ring, more preferably a benzene ring substituted by an alkyl group having 1 to 6 carbon atoms, a benzene ring substituted by an alkoxy group having 1 to 6 carbon atoms, or a benzene ring substituted by a hydroxyl group, most preferably a benzene ring substituted by an alkyl group having 1 to 4 carbon atoms, or a benzene ring substituted by an alkoxy group having 1 to 4 carbon atoms.

The ring D is preferably a benzene ring substituted by an alkyl group having 1 to 8 carbon atoms, or an unsubstituted benzene ring, more preferably a benzene ring substituted by an alkyl group having 1 to 6 carbon atoms, or an unsubstituted benzene ring, most preferably a benzene ring substituted by an alkyl group having 1 to 4 carbon atoms, or an unsubstituted benzene ring.

The ring E is preferably a benzene ring substituted by a hydroxyl group and an alkyl group having 1 to 8 carbon atoms, or a benzene ring substituted by a hydroxyl group and an alkoxy group having 1 to 8 carbon atoms, more preferably a benzene ring substituted by a hydroxyl group and an alkyl group having 1 to 6 carbon atoms, or a benzene ring substituted by a hydroxyl group and an alkoxy group having 1 to 6 carbon atoms, most preferably a benzene ring substituted by a hydroxyl group and an alkyl group having 1 to 4 carbon atoms, or a benzene ring substituted by a hydroxyl group and an alkoxy group having 1 to 4 carbon atoms.

Formula (Y7)

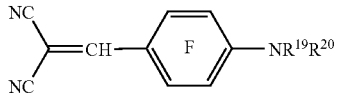

In the formula (Y7), the ring F represents a substituted or unsubstituted benzene ring; and $R^{19}$ and $R^{20}$ each independently represent a hydrogen atom, a substituted or unsubstituted alkyl group, a substituted or unsubstituted alkenyl group or a substituted or unsubstituted aryl group.

Each of the ring F and the groups represented by $R^{19}$ and $R^{20}$ may further have a substituent. Examples of a substituent by which each of the ring F and the groups of $R^{19}$ and $R^{20}$ may be substituted include the same substituents as each of the ring A and the substituents $R^1$ to $R^4$ in the formula (Y1) may have.

Examples of a preferred combination of the ring F and the substituents $R^{19}$ and $R^{20}$ in a dye represented by the formula (Y7) include combinations wherein the ring F is an unsubstituted benzene ring, $R^{19}$ is a substituted or unsubstituted alkyl group having 1 to 8 carbon atoms, an allyl group or a substituted or unsubstituted aryl group having 6 to 10 carbon atoms, and $R^{20}$ is a substituted or unsubstituted alkyl group having 1 to 8 carbon atoms, an allyl group or a substituted or unsubstituted aryl group having 6 to 10 carbon atoms.

In more preferred combinations of the ring F and the substituents $R^{19}$ and $R^{20}$, the ring F is a substituted or unsubstituted benzene ring, $R^{19}$ is a substituted or unsubstituted alkyl group having 1 to 6 carbon atoms, an allyl group or a substituted or unsubstituted phenyl group, and $R^{20}$ is a substituted or unsubstituted alkyl group having 1 to 6 carbon atoms, an allyl group or a substituted or unsubstituted phenyl group.

In the most preferred combinations thereof, the ring F is a benzene ring substituted by a methyl group, $R^{19}$ is an unsubstituted alkyl group having 1 to 4 carbon atoms, and $R^{20}$ is a substituted alkyl group having 1 to 4 carbon atoms.

Formula (Y8)

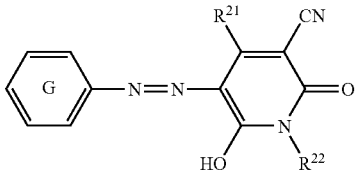

In the formula (Y8), the ring G represents a substituted or unsubstituted benzene ring; and $R^{21}$ and $R^{22}$ each independently represent a hydrogen atom or a substituted or unsubstituted alkyl group.

Each of the ring G and the groups represented by $R^{21}$ and $R^{22}$ may further have a substituent. Examples of a substituent by which each of the ring G and the groups of $R^{21}$ and $R^{22}$ may be substituted include the same substituents as each of the ring A and the substituents $R^1$ to $R^4$ in the formula (Y1) may have.

Examples of a preferred combination of the ring G and the substituents $R^{21}$ and $R^{22}$ include combinations wherein the ring G is a benzene ring having a substituent(s), $R^{21}$ is a substituted or unsubstituted alkyl group having 1 to 8 carbon atoms, and $R^{22}$ is a substituted or unsubstituted alkyl group having 1 to 8 carbon atoms.

In more preferred combinations thereof, the ring G is a benzene ring substituted by a substituted or unsubstituted alkoxycarbonyl group, $R^{21}$ is a substituted or unsubstituted alkyl group having 1 to 6 carbon atoms, and $R^{22}$ is a substituted or unsubstituted alkyl group having 1 to 6 carbon atoms.

In the most preferred combinations thereof, the ring G is a benzene ring substituted by a substituted or unsubstituted alkoxycarbonyl group, $R^{21}$ is a substituted or unsubstituted alkyl group having 1 to 4 carbon atoms, and $R^{22}$ is a substituted or unsubstituted alkyl group having 1 to 4 carbon atoms.

Formula (Y9)

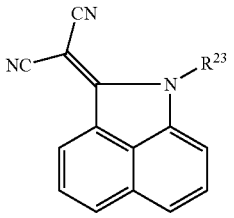

In the formula (Y9), $R^{23}$ represents a substituted or unsubstituted alkyl group or a substituted or unsubstituted alkenyl group.

The group represented by $R^{23}$ may further have a substituent. Examples of a substituent by which the group of $R^{23}$ may be substituted include the same substituents as each of the ring A and the substituents $R^1$ to $R^4$ in the formula (Y1) may have.

$R^{23}$ is preferably a substituted or unsubstituted alkyl group having 1 to 8 carbon atoms or an allyl group, more preferably a substituted or unsubstituted alkyl group having 1 to 6 carbon atoms or an allyl group, and most preferably a substituted or unsubstituted alkyl group having 1 to 4 carbon atoms or an allyl group.

Formula (M1)

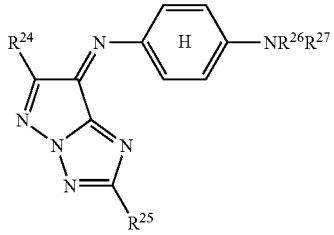

In the formula (M1), the ring H represents a substituted or unsubstituted benzene ring or a substituted or unsubstituted pyridine ring; and $R^{24}$, $R^{25}$, $R^{26}$ and $R^{27}$ each independently represent a substituted or unsubstituted alkyl group, a substituted or unsubstituted alkenyl group or a substituted or unsubstituted aryl group.

Each of the ring H and the groups represented by $R^{24}$, $R^{25}$, $R^{26}$ and $R^{27}$ may further have a substituent. Examples of a substituent by which each of the ring H and the groups of $R^{24}$, $R^{25}$, $R^{26}$ and $R^{27}$ may be substituted include the same substituents as each of the ring A and the substituents $R^1$ to $R^4$ in the formula (Y1) may have.

Examples of a preferred combination of the ring H and the substituents $R^{24}$ to $R^{27}$ in a dye represented by the formula (M1) include combinations wherein the ring H is an unsubstituted benzene ring, $R^{24}$ is a substituted or unsubstituted alkyl group having 1 to 8 carbon atoms or a substituted or unsubstituted aryl group having 6 to 10 carbon atoms, $R^{25}$ is a substituted or unsubstituted alkyl group having 1 to 8 carbon atoms or a substituted or unsubstituted aryl group having 6 to 10 carbon atoms, $R^{26}$ is a substituted or unsubstituted alkyl group having 1 to 8 carbon atoms or an allyl group, and $R^{27}$ is a substituted or unsubstituted alkyl group having 1 to 8 carbon atoms or an allyl group.

In more preferred combinations of the ring H and the substituents $R^{24}$ to $R^{27}$, the ring H is an unsubstituted benzene ring, $R^{24}$ is a substituted or unsubstituted phenyl group, $R^{25}$ is a substituted or unsubstituted alkyl group having 1 to 8 carbon atoms, $R^{26}$ is a substituted or unsubstituted alkyl group having 1 to 6 carbon atoms, and $R^{27}$ is a substituted or unsubstituted alkyl group having 1 to 6 carbon atoms.

In the most preferred combinations, the ring H is an unsubstituted benzene ring, $R^{24}$ is a 2-chlorophenyl group, $R^{25}$ is a substituted or unsubstituted alkyl group having 1 to 4 carbon atoms, $R^{26}$ is a substituted or unsubstituted alkyl group having 1 to 4 carbon atoms, and $R^{27}$ is a substituted or unsubstituted alkyl group having 1 to 4 carbon atoms.

Formula (M2)

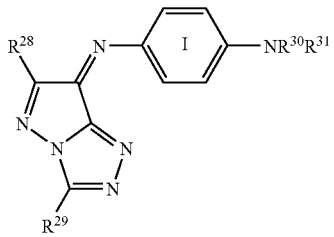

In the formula (M2), the ring I represents a substituted or unsubstituted benzene ring or a substituted or unsubstituted pyridine ring; and $R^{28}$, $R^{29}$, $R^{30}$ and $R^{31}$ each independently represent a substituted or unsubstituted alkyl group, a substituted or unsubstituted alkenyl group or a substituted or unsubstituted aryl group.

Each of the ring I and the groups represented by $R^{28}$, $R^{29}$, $R^{30}$ and $R^{31}$ may further have a substituent. Examples of a substituent by which each of the ring I and the groups of $R^{28}$, $R^{29}$, $R^{30}$ and $R^{31}$ may be substituted include the same substituents as each of the ring A and the substituents $R^1$ to $R^4$ in the formula (Y1) may have.

Examples of a preferred combination of the ring I and the substituents $R^{28}$ to $R^{31}$ in a dye represented by the formula (M2) include combinations wherein the ring I is a substituted or unsubstituted pyridine ring or an unsubstituted benzene ring, $R^{28}$ is a substituted or unsubstituted alkyl group having 1 to 8 carbon atoms or a substituted or unsubstituted aryl group having 6 to 10 carbon atoms, $R^{29}$ is a substituted or unsubstituted alkyl group having 1 to 8 carbon atoms or a substituted or unsubstituted aryl group having 6 to 10 carbon atoms, $R^{30}$ is a substituted or unsubstituted alkyl group having 1 to 8 carbon atoms or an allyl group, and $R^{31}$ is a substituted or unsubstituted alkyl group having 1 to 8 carbon atoms or an allyl group.

In more preferred combinations of the ring I and the substituents $R^{28}$ to $R^{31}$, the ring I is a substituted or unsubstituted pyridine ring or an unsubstituted benzene ring, $R^{28}$ is a substituted or unsubstituted alkyl group having 1 to 6 carbon atoms, $R^{29}$ is a substituted or unsubstituted alkyl group having 1 to 6 carbon atoms, $R^{30}$ is a substituted or unsubstituted alkyl group having 1 to 6 carbon atoms, and $R^{31}$ is a substituted or unsubstituted alkyl group having 1 to 6 carbon atoms.

In the most preferred combinations thereof, the ring I is a substituted or unsubstituted pyridine ring or an unsubstituted benzene ring, $R^{28}$ is a substituted or unsubstituted alkyl group having 1 to 4 carbon atoms, $R^{29}$ is a substituted or unsubstituted alkyl group having 1 to 4 carbon atoms, $R^{30}$ is a substituted or unsubstituted alkyl group having 1 to 4 carbon atoms, and $R^{31}$ is a substituted or unsubstituted alkyl group having 1 to 4 carbon atoms.

Formula (M3)

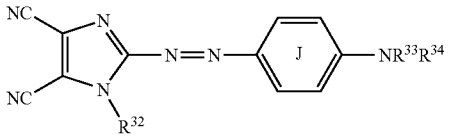

In the formula (M3), the ring J represents a substituted or unsubstituted benzene ring, and $R^{32}$, $R^{33}$ and $R^{34}$ each independently represent a substituted or unsubstituted alkyl group, a substituted or unsubstituted alkenyl group or a substituted or unsubstituted aryl group.

Each of the ring J and the groups represented by $R^{32}$, $R^{33}$ and $R^{34}$ may further have a substituent. Examples of a substituent by which each of the ring J and the groups of $R^{32}$, $R^{33}$ and $R^{34}$ may be substituted include the same substituents as each of the ring A and the substituents $R^1$ to $R^4$ in the formula (Y1) may have.

Examples of a preferred combination of the ring J and the substituents $R^{32}$ to $R^{34}$ in a dye represented by the formula (M3) include combinations wherein the ring J is a benzene ring substituted by an acylamino group having 2 to 8 carbon atoms, $R^{32}$ is a substituted or unsubstituted alkyl group having 1 to 8 carbon atoms or an acyl group, $R^{33}$ is a substituted or unsubstituted alkyl group having 1 to 8 carbon atoms or an allyl group, and $R^{34}$ is a substituted or unsubstituted alkyl group having 1 to 8 carbon atoms or an allyl group.

In more preferred combinations of the ring J and the substituents $R^{32}$ to $R^{34}$, the ring J is a benzene ring substituted by an acylamino group having 2 to 6 carbon atoms, $R^{32}$ is a substituted or unsubstituted alkyl group having 1 to 6 carbon atoms or an acyl group, $R^{33}$ is a substituted or unsubstituted alkyl group having 1 to 6 carbon atoms or an allyl group, and $R^{34}$ is a substituted or unsubstituted alkyl group having 1 to 6 carbon atoms or an allyl group.

In the most preferred combinations thereof, the ring J is a benzene ring substituted by an acylamino group having 2 to 4 carbon atoms, $R^{32}$ is a substituted or unsubstituted alkyl group having 1 to 4 carbon atoms or an acyl group, $R^{33}$ is a substituted or unsubstituted alkyl group having 1 to 4 carbon atoms or an allyl group, and $R^{34}$ is a substituted or unsubstituted alkyl group having 1 to 4 carbon atoms or an allyl group.

Formula (M4)

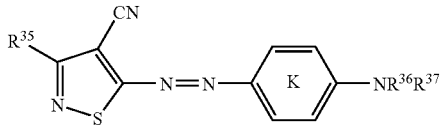

In the formula (M4), the ring K represents a substituted or unsubstituted benzene ring, and $R^{35}$, $R^{36}$ and $R^{37}$ each independently represent a substituted or unsubstituted alkyl group, a substituted or unsubstituted alkenyl group or a substituted or unsubstituted aryl group.

Each of the ring K and the groups represented by $R^{35}$, $R^{36}$ and $R^{37}$ may further have a substituent. Examples of a substituent by which each of the ring K and the groups of $R^{35}$, $R^{36}$ and $R^{37}$ may be substituted include the same substituents as each of the ring A and the substituents $R^1$ to $R^4$ in the formula (Y1) may have.

Examples of a preferred combination of the ring K and the substituents $R^{35}$ to $R^{37}$ in a dye represented by the formula (M4) include combinations wherein the ring K is a benzene ring substituted by an acylamino group having 2 to 8 carbon atoms, $R^{35}$ is a substituted or unsubstituted alkyl group having 1 to 8 carbon atoms, $R^{36}$ is a substituted or unsubstituted alkyl group having 1 to 8 carbon atoms or an allyl group, and $R^{37}$ is a substituted or unsubstituted alkyl group having 1 to 8 carbon atoms or an allyl group.

In more preferred combinations of the ring K and the substituents $R^{35}$ to $R^{37}$, the ring K is a benzene ring substituted by an acylamino group having 2 to 6 carbon atoms, $R^{35}$ is a substituted or unsubstituted alkyl group having 1 to 6 carbon atoms, $R^{36}$ is a substituted or unsubstituted alkyl group having 1 to 6 carbon atoms or an allyl group, and $R^{37}$ is a substituted or unsubstituted alkyl group having 1 to 6 carbon atoms or an allyl group.

In the most preferred combinations thereof, the ring K is a benzene ring substituted by an acylamino group having 2 to 4 carbon atoms, $R^{35}$ is a substituted or unsubstituted alkyl group having 1 to 4 carbon atoms, $R^{36}$ is a substituted or unsubstituted alkyl group having 1 to 4 carbon atoms or an allyl group, and $R^{37}$ is a substituted or unsubstituted alkyl group having 1 to 4 carbon atoms or an allyl group.

Formula (M5)

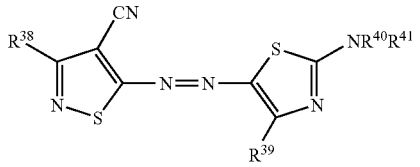

In the formula (M5), $R^{38}$ and $R^{39}$ each independently represent a substituted or unsubstituted alkyl group, a substituted or unsubstituted aryl group, or a substituted or unsubstituted heterocyclic group, and $R^{40}$ and $R^{41}$ each independently represent a substituted or unsubstituted alkyl group, a substituted or unsubstituted alkenyl group, or a substituted or unsubstituted aryl group.

Each of the groups represented by $R^{38}$ to $R^{41}$ may further have a substituent. Examples of a substituent by which $R^{38}$ to $R^{41}$ each may be substituted include the same substituents as each of the ring A and the substituents $R^1$ to $R^4$ in the formula (Y1) may have.

Examples of a preferred combination of the substituents $R^{38}$ to $R^{41}$ in a dye represented by the formula (M5) include combinations wherein $R^{38}$ is a substituted or unsubstituted alkyl group having 1 to 8 carbon atoms or a substituted or unsubstituted aryl group having 6 to 10 carbon atoms, $R^{39}$ is a substituted or unsubstituted alkyl group having 1 to 8 carbon atoms or a substituted or unsubstituted aryl group having 6 to 10 carbon atoms, $R^{40}$ is a substituted or unsubstituted alkyl group having 1 to 8 carbon atoms or a substituted or unsubstituted aryl group having 6 to 10 carbon atoms, and $R^{41}$ is a substituted or unsubstituted alkyl group having 1 to 8 carbon atoms or a substituted or unsubstituted aryl group having 6 to 10 carbon atoms.

In more preferred combinations of the substituents $R^{38}$ to $R^{41}$, $R^{38}$ is a substituted or unsubstituted alkyl group having 1 to 6 carbon atoms or a substituted or unsubstituted phenyl group, $R^{39}$ is a substituted or unsubstituted alkyl group having 1 to 6 carbon atoms or a substituted or unsubstituted phenyl group, $R^{40}$ is a substituted or unsubstituted alkyl group having 1 to 6 carbon atoms, and $R^{41}$ is a substituted or unsubstituted alkyl group having 1 to 6 carbon atoms.

In the most preferred combinations thereof, $R^{38}$ is a substituted or unsubstituted alkyl group having 1 to 4 carbon atoms or a substituted or unsubstituted phenyl group, $R^{39}$ is a substituted or unsubstituted alkyl group having 1 to 4 carbon atoms or a substituted or unsubstituted phenyl group, $R^{40}$ is a substituted or unsubstituted alkyl group having 1 to 4 carbon atoms, and $R^{41}$ is a substituted or unsubstituted alkyl group having 1 to 4 carbon atoms.

Formula (M6)

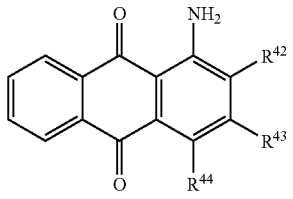

In the formula (M6), $R^{42}$ is a substituted or unsubstituted aryloxy group, $R^{43}$ is a hydrogen atom, or a substituted or unsubstituted aryloxy group, and $R^{44}$ is a hydroxyl group, or a substituted or unsubstituted amino group.

Each of the groups represented by $R^{42}$ and $R^{43}$ may further have a substituent. Examples of a substituent by which each of the groups of $R^{42}$ and $R^{43}$ may be substituted include the same substituents as each of the ring A and the substituents $R^1$ to $R^4$ in the formula (Y1) may have.

Examples of a preferred combination of the groups $R^{42}$ to $R^{44}$ in the dye represented by the formula (M6) include combinations wherein $R^{42}$ is a substituted or unsubstituted aryloxy group having 6 to 10 carbon atoms, $R^{43}$ is a hydrogen atom, or a substituted or unsubstituted aryloxy group having 6 to 10 carbon atoms, and $R^{44}$ is a hydroxyl group, or an unsubstituted amino group.

In more preferred combinations thereof, $R^{42}$ is a substituted or unsubstituted phenoxy group, $R^{43}$ is a hydrogen atom or a substituted or unsubstituted phenoxy group, and $R^{44}$ is a hydroxyl group, or an unsubstituted amino group.

In the most preferred combinations thereof, $R^{42}$ is a phenoxy group substituted by a substituted or unsubstituted amino group, or an unsubstituted phenoxy group, $R^{43}$ is a hydrogen atom, or a substituted or unsubstituted phenoxy group, and $R^{44}$ is a hydroxyl group, or an unsubstituted amino group.

Formula (M7)

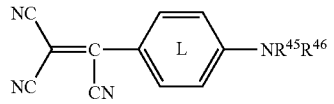

In the formula (M7), the ring L represents a substituted or unsubstituted benzene ring; and $R^{45}$ and $R^{46}$ each independently represent a hydrogen atom, a substituted or unsubstituted alkyl group, a substituted or unsubstituted alkenyl group or a substituted or unsubstituted aryl group.

Each of the ring L and the groups represented by $R^{45}$ and $R^{46}$ may further have a substituent. Examples of a substituent by which each of the ring L and the groups of $R^{45}$ and $R^{46}$ may be substituted include the same substituents as each of the ring A and the substituents $R^1$ to $R^4$ in the formula (Y1) may have.

Examples of a preferred combination of the ring L and the substituents $R^{45}$ and $R^{46}$ include combinations wherein the ring L is a substituted or unsubstituted benzene ring, $R^{45}$ is a substituted or unsubstituted alkyl group having 1 to 8 carbon atoms, an allyl group, or a substituted or unsubstituted aryl group having 6 to 10 carbon atoms, and $R^{46}$ is a substituted or unsubstituted alkyl group having 1 to 8 carbon atoms, an allyl group, or a substituted or unsubstituted aryl group having 6 to 10 carbon atoms.

In more preferred combinations of the ring L and the substituents $R^{45}$ and $R^{46}$, the ring L is a substituted or unsubstituted benzene ring, $R^{45}$ is a substituted or unsubstituted alkyl group having 1 to 6 carbon atoms, an allyl group, or a substituted or unsubstituted phenyl group, and $R^{46}$ is a substituted or unsubstituted alkyl group having 1 to 6 carbon atoms, an allyl group, or a substituted or unsubstituted phenyl group.

In the most preferred combinations thereof, the ring L is a benzene ring substituted by a methyl group, $R^{45}$ is an unsubstituted alkyl group having 1 to 4 carbon atoms, and $R^{46}$ is an alkyl group having 1 to 4 carbon atoms and a substituent(s).

Formula (M8)

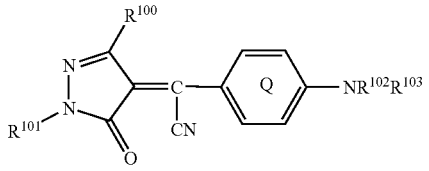

In the formula (M8), the ring Q represents a substituted or unsubstituted benzene ring, $R^{100}$ represents a substituted or unsubstituted alkyl group, a substituted or unsubstituted aryl group, a substituted or unsubstituted alkoxy group, or a substituted or unsubstituted amino group, $R^{101}$ represents a substituted or unsubstituted alkyl group, or a substituted or unsubstituted aryl group, $R^{102}$ and $R^{103}$ each independently represent a hydrogen atom, a substituted or unsubstituted alkyl group, a substituted or unsubstituted alkenyl group, or a substituted or unsubstituted aryl group.

Each of the ring Q and the groups represented by $R^{100}$, $R^{101}$, $R^{102}$ and $R^{103}$ may further have a substituent. Examples of a substituent by which each of the ring Q and the groups of $R^{100}$, $R^{101}$, $R^{102}$ and $R^{103}$ may be substituted include the same substituents as each of the ring A and the substituents $R^1$ to $R^4$ in the formula (Y1) may have.

Examples of a preferred combination of the ring Q and the groups $R^{100}$ to $R^{103}$ in the dye represented by the formula (M8) include combinations wherein the ring Q is a substituted or unsubstituted benzene ring, $R^{102}$ is a substituted or unsubstituted alkyl group having 1 to 8 carbon atoms, an allyl group, or a substituted or unsubstituted aryl group having 6 to 10 carbon atoms, $R^{103}$ is a substituted or unsubstituted alkyl group having 1 to 8 carbon atoms, an allyl group, or a substituted or unsubstituted aryl group having 6 to 10 carbon atoms, $R^{100}$ is a substituted or unsubstituted amino group, or a substituted or unsubstituted alkoxy group, and $R^{101}$ is a substituted or unsubstituted alkyl group having 1 to 8 carbon atoms, or a substituted or unsubstituted aryl group having 6 to 10 carbon atoms.

In more preferred combinations thereof, the ring Q is a substituted or unsubstituted benzene ring, $R^{102}$ is a substituted or unsubstituted alkyl group having 1 to 6 carbon atoms, an allyl group, or a substituted or unsubstituted phenyl group, $R^{103}$ is a substituted or unsubstituted alkyl group having 1 to 6 carbon atoms, an allyl group, or a substituted or unsubstituted phenyl group, $R^{100}$ is a substituted or unsubstituted amino group, or a substituted or unsubstituted alkoxy group, and $R^{101}$ is a substituted or unsubstituted alkyl group having 1 to 6 carbon atoms, or a substituted or unsubstituted phenyl group.

In the most preferred combinations thereof, the ring Q is a substituted or unsubstituted benzene ring, $R^{102}$ is a substituted or unsubstituted alkyl group having 1 to 4 carbon atoms, or an allyl group, $R^{103}$ is a substituted or unsubstituted alkyl group having 1 to 4 carbon atoms, or an allyl group, $R^{100}$ is a substituted or unsubstituted amino group, or a substituted or unsubstituted alkoxy group, and $R^{101}$ is a substituted or unsubstituted phenyl group.

Formula (C1)

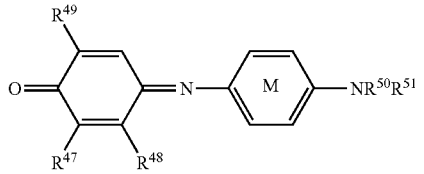

In the formula (C1), the ring M represents a substituted or unsubstituted benzene ring, $R^{47}$ represents a hydrogen atom or a halogen atom, $R^{48}$ represents a substituted or unsubstituted alkyl group, $R^{49}$ represents a substituted or unsubstituted acylamino group or a substituted or unsubstituted alkoxycarbonylamino group, and $R^{50}$ and $R^{51}$ each independently represent a substituted or unsubstituted alkyl group, a substituted or unsubstituted alkenyl group or a substituted or unsubstituted aryl group.

Each of the ring M and the groups represented by $R^{48}$, $R^{49}$, $R^{50}$ and $R^{51}$ may further have a substituent. Examples of a substituent by which each of the ring M and the groups of $R^{48}$, $R^{49}$, $R^{50}$ and $R^{51}$ may be substituted include the same substituents as each of the ring A and the substituents $R^1$ to $R^4$ in the formula (Y1) may have.

Examples of a preferred combination of the ring M and the substituents $R^{47}$ to $R^{51}$ include combinations wherein the ring M is a benzene ring substituted by an alkyl group having 1 to 4 carbon atoms, a benzene ring substituted by a chlorine atom or an unsubstituted benzene ring, $R^{47}$ is a hydrogen atom, a chlorine atom or a bromine atom, $R^{48}$ is a substituted or unsubstituted alkyl group having 1 to 8 carbon atoms, $R^{49}$ is a substituted or unsubstituted acylamino group having 2 to 10 carbon atoms or a substituted or unsubstituted alkoxycarbonylamino group having 2 to 10 carbon atoms, $R^{50}$ is a substituted or unsubstituted alkyl group having 1 to 8 carbon atoms, and $R^{51}$ is a substituted or unsubstituted alkyl group having 1 to 8 carbon atoms.

In preferred combinations of the ring M and the substituents $R^{47}$ to $R^{51}$, the ring M is a benzene ring substituted by an alkyl group having 1 to 2 carbon atoms or an unsubstituted benzene ring, $R^{47}$ is a hydrogen atom or a chlorine atom, $R^{48}$ is a substituted or unsubstituted alkyl group having 1 to 6 carbon atoms, $R^{49}$ is a substituted or unsubstituted acylamino group having 2 to 8 carbon atoms or a substituted or unsubstituted alkoxycarbonylamino group having 2 to 8 carbon atoms, $R^{50}$ is a substituted or unsubstituted alkyl group having 1 to 6 carbon atoms, and $R^{51}$ is a substituted or unsubstituted alkyl group having 1 to 6 carbon atoms.

In the most preferred combinations thereof, the ring M is a benzene ring substituted by a methyl group or an unsubstituted benzene ring, $R^{47}$ is a hydrogen atom or a chlorine atom, $R^{48}$ is a substituted or unsubstituted alkyl group having 1 to 6 carbon atoms, $R^{49}$ is a substituted or unsubstituted acylamino group having 2 to 6 carbon atoms or a substituted or unsubstituted alkoxycarbonylamino group having 2 to 6 carbon atoms, $R^{50}$ is a substituted or unsubstituted alkyl group having 1 to 4 carbon atoms, and $R^{51}$ is a substituted or unsubstituted alkyl group having 1 to 4 carbon atoms.

Formula (C2)

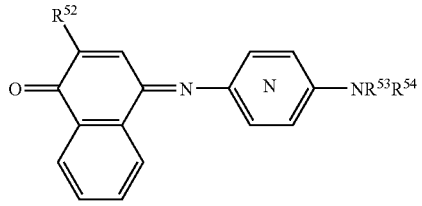

In the formula (C2), the ring N represents a substituted or unsubstituted benzene ring, $R^{52}$ represents a hydrogen atom, a substituted or unsubstituted acylamino group, a substituted or unsubstituted alkoxycarbonyl group, or a substituted or unsubstituted carbamoyl group, and $R^{53}$ and $R^{54}$ each independently represent a substituted or unsubstituted alkyl group, a substituted or unsubstituted alkenyl group, or a substituted or unsubstituted aryl group.

Each of the ring N and the groups represented by $R^{52}$, $R^{53}$ and $R^{54}$ may further have a substituent. Examples of a substituent by which each of the ring N and the groups of $R^{52}$, $R^{53}$ and $R^{54}$ may be substituted include the same substituents as each of the ring A and the substituents $R^1$ to $R^4$ in the formula (Y1) may have.

Examples of a preferred combination of the ring N and the groups $R^{52}$ to $R^{54}$ in the dye represented by the formula (C2) include combinations wherein the ring N is a benzene ring substituted by an alkyl group having 1 to 8 carbon atoms, a benzene ring substituted by an alkoxy group having 1 to 8 carbon atoms, or an unsubstituted benzene ring, $R^{52}$ is a hydrogen atom, a substituted or unsubstituted acylamino group having 2 to 10 carbon atoms, a substituted or unsubstituted alkoxycarbonyl group having 2 to 10 carbon atoms, or a substituted or unsubstituted carbamoyl group having 1 to 10 carbon atoms, $R^{53}$ is a substituted or unsubstituted alkyl group having 1 to 8 carbon atoms, and $R^{54}$ is a substituted or unsubstituted alkyl group having 1 to 8 carbon atoms.

In more preferred combinations thereof, the ring N is a benzene ring substituted by an alkyl group having 1 to 6 carbon atoms, a benzene ring substituted by an alkoxy group having 1 to 6 carbon atoms, or an unsubstituted benzene ring, $R^{52}$ is a hydrogen atom, a substituted or unsubstituted acylamino group having 2 to 8 carbon atoms, a substituted or unsubstituted alkoxycarbonyl group having 2 to 8 carbon atoms, or a substituted or unsubstituted carbamoyl group having 1 to 8 carbon atoms, $R^{53}$ is a substituted or unsubstituted alkyl group having 1 to 6 carbon atoms, and $R^{54}$ is a substituted or unsubstituted alkyl group having 1 to 6 carbon atoms.

In the most preferred combinations thereof, the ring N is a benzene ring substituted by an alkyl group having 1 to 4 carbon atoms, a benzene ring substituted by an alkoxy group having 1 to 4 carbon atoms, or an unsubstituted benzene ring, $R^{52}$ is a hydrogen atom, a substituted or unsubstituted acylamino group having 2 to 6 carbon atoms, a substituted or unsubstituted alkoxycarbonyl group having 2 to 6 carbon atoms, or a substituted or unsubstituted carbamoyl group having 1 to 6 carbon atoms, $R^{53}$ is a substituted or unsubstituted alkyl group having 1 to 4 carbon atoms, and $R^{54}$ is a substituted or unsubstituted alkyl group having 1 to 4 carbon atoms.

Formula (C3)

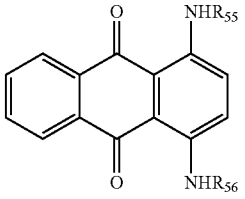

In the formula (C3), $R^{55}$ and $R^{56}$ each independently represent an alkyl group, or a substituted or unsubstituted aryl group.

Each of the groups represented by $R^{55}$ and $R^{56}$ may further have a substituent. Examples of a substituent by which each of the groups of $R^{55}$ and $R^{56}$ may be substituted include the same substituents as each of the ring A and the substituents $R^1$ to $R^4$ in the formula (Y1) may have.

Examples of a preferred combination of the substituents $R^{55}$ and $R^{56}$ in a dye represented by the formula (C3) include combinations wherein $R^{55}$ is a substituted or unsubstituted alkyl group having 1 to 8 carbon atoms or a substituted or unsubstituted aryl group having 6 to 10 carbon atoms, $R^{56}$ is a substituted or unsubstituted alkyl group having 1 to 8 carbon atoms or a substituted or unsubstituted aryl group having 6 to 10 carbon atoms.

In more preferred combinations of the substituents $R^{55}$ and $R^{56}$, $R^{55}$ is a substituted or unsubstituted alkyl group having 1 to 6 carbon atoms or a substituted or unsubstituted phenyl group, $R^{56}$ is a substituted or unsubstituted alkyl group having 1 to 6 carbon atoms or a substituted or unsubstituted phenyl group.

In the most preferred combinations thereof, $R^{55}$ is a substituted or unsubstituted alkyl group having 1 to 4 carbon atoms, $R^{56}$ is a substituted or unsubstituted alkyl group having 1 to 4 carbon atoms or a substituted or unsubstituted phenyl group.

Formula (C4)

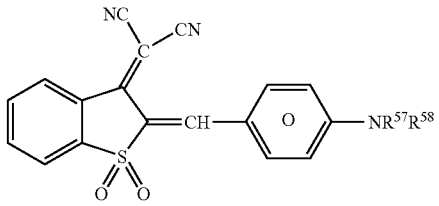

In the formula (C4), the ring O represents a substituted or unsubstituted benzene ring, and $R^{57}$ and $R^{58}$ each independently represent a substituted or unsubstituted alkyl group, a substituted or unsubstituted alkenyl group, or a substituted or unsubstituted aryl group.

Each of the ring O and the groups represented by $R^{57}$ and $R^{58}$ may further have a substituent. Examples of a substituent by which each of the ring O and the groups of $R^{57}$ and $R^{58}$ may be substituted include the same substituents as each of the ring A and the substituents $R^1$ to $R^4$ in the formula (Y1) may have.

Examples of a preferred combination of the ring O and the groups $R^{57}$ and $R^{58}$ in the dye represented by the formula (C4) include combinations wherein the ring O is a benzene ring substituted by an alkyl group having 1 to 8 carbon atoms, a benzene ring substituted by an alkoxy group having 1 to 8 carbon atoms, or an unsubstituted benzene ring, $R^{57}$ is a substituted or unsubstituted alkyl group having 1 to 8 carbon atoms, and $R^{58}$ is a substituted or unsubstituted alkyl group having 1 to 8 carbon atoms.

In more preferred combinations thereof, the ring O is a benzene ring substituted by an alkyl group having 1 to 6 carbon atoms, a benzene ring substituted by an alkoxy group having 1 to 6 carbon atoms, or an unsubstituted benzene ring, $R^{57}$ is a substituted or unsubstituted alkyl group having 1 to 6 carbon atoms, and $R^{58}$ is a substituted or unsubstituted alkyl group having 1 to 6 carbon atoms.

In the most preferred combinations thereof, the ring O is a benzene ring substituted by an alkyl group having 1 to 4 carbon atoms, a benzene ring substituted by an alkoxy group having 1 to 4 carbon atoms, or an unsubstituted benzene ring, $R^{57}$ is a substituted or unsubstituted alkyl group having 1 to 4 carbon atoms, and $R^{58}$ is a substituted or unsubstituted alkyl group having 1 to 4 carbon atoms.

Specific examples of compounds as the dyes represented by the formulae (Y1) to (Y9), (M1) to (M8) and (C1) to (C4), which can be preferably used in the invention, are illustrated below. However, the dyes represented by the formulae (Y1) to (Y9), (M1) to (M8) and (C1) to (C4) used in the invention should not be restrictedly interpreted by the specific examples illustrated below.

TABLE 1

The dyes represented by the formula (Y1)

| Examples of compounds | Ring A | $R^1$ | $R^2$ | $R^3$ | $R^4$ |
|---|---|---|---|---|---|
| Y1-1 | 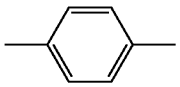 | Ethyl | Ethyl | Ethoxy | Phenyl |
| Y1-2 | 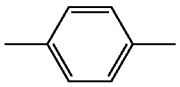 | Ethyl | Ethyl | Dimethylamino | Phenyl |
| Y1-3 | 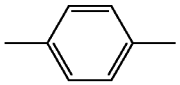 | n-Propyl | n-Propyl | Ethoxy | Phenyl |
| Y1-4 | 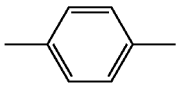 | n-Butyl | n-Butyl | Ethoxy | Phenyl |

TABLE 2

The dyes represented by the formula (Y2)

| Examples of compounds | $R^5$ | $R^6$ | $R^7$ | $R^8$ | $R^9$ |
|---|---|---|---|---|---|
| Y2-1 | Ethyl | Methyl | Methyl | Dimethylamino | Phenyl |
| Y2-2 | n-Propyl | Methyl | Methyl | Dimethylamino | Phenyl |
| Y2-3 | Allyl | Methyl | Methyl | Dimethylamino | Phenyl |
| Y2-4 | Ethyl | Methyl | Methyl | Ethoxy | Phenyl |

TABLE 3

The dyes represented by the formula (Y3)

| Examples of compounds | $R^{10}$ | $R^{11}$ | $R^{12}$ |
|---|---|---|---|
| Y3-1 | Isopropyl | Hydrogen | Di-n-butyl-carbamoyl |
| Y3-2 | Hydrogen | Bromo | Di-n-propyl-carbamoyl |

TABLE 4

The dyes represented by the formula (Y4)

| Examples of compounds | Ring B | $R^{13}$ | $R^{14}$ |
|---|---|---|---|
| Y4-1 | 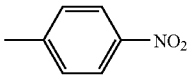 | t-Butyl | Phenyl |
| Y4-2 | 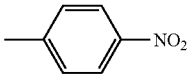 | t-Butyl | Methyl |
| Y4-3 | 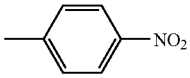 | t-Butyl | 4-(Ethoxycarbonyl)phenyl |

TABLE 5

The dyes represented by the formula (Y5)

| Examples of compounds | $R^{15}$ | $R^{16}$ | $R^{17}$ | $R^{18}$ |
|---|---|---|---|---|
| Y5-1 | Methyl | Methyl | Phenyl | Phenyl |
| Y5-2 | Methyl | Methyl | Methyl | Methyl |

TABLE 6

The dyes represented by the formula (Y6)

| Examples of compounds | Ring C | Ring D | Ring E |
|---|---|---|---|
| Y6-1 | 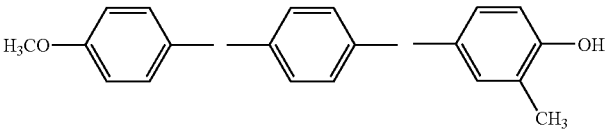 | | |

TABLE 6-continued

| The dyes represented by the formula (Y6) | | | |
|---|---|---|---|
| Examples of compounds | Ring C | Ring D | Ring E |
| Y6-2 | 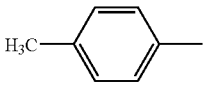 | 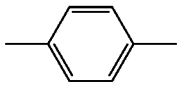 | 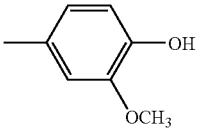 |

TABLE 7

| The dyes represented by the formula (Y7) | | | |
|---|---|---|---|
| Examples of compounds | Ring F | $R^{19}$ | $R^{20}$ |
| Y7-1 | 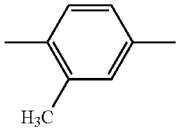 | n-Butyl | Benzyl |
| Y7-2 | 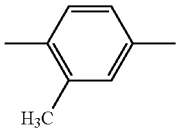 | Ethyl | 4-Cyclohexyl phenoxyethyl |
| Y7-3 | 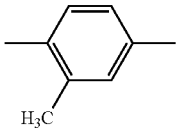 | Ethyl | Phenethyl |
| Y7-4 | 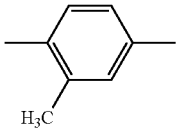 | n-Butyl | 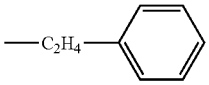 |

TABLE 8

| The dyes represented by the formula (Y8) | | | |
|---|---|---|---|
| Examples of compounds | Ring G | $R^{21}$ | $R^{22}$ |
| Y8-1 | 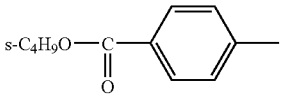 | Methyl | s-Butyl |
| Y8-2 | 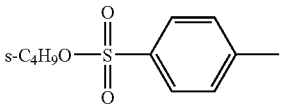 | Methyl | t-Pentyl |

TABLE 9

| The dyes represented by the formula (Y9) | |
|---|---|
| Examples of compounds | $R^{23}$ |
| Y9-1 | Ethyl |
| Y9-2 | n-Propyl |
| Y9-3 | n-Butyl |

TABLE 10

| The dyes represented by the formula (M1) | | | | | |
|---|---|---|---|---|---|
| Examples of compounds | Ring H | $R^{24}$ | $R^{25}$ | $R^{26}$ | $R^{27}$ |
| M1-1 | 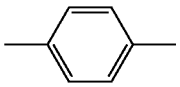 | 2-Chlorophenyl | Isopropyl | n-Butyl | Cyanoethyl |
| M1-2 | 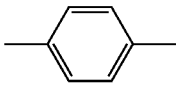 | 2-Chlorophenyl | Isopropyl | Acetoxyethyl | Acetoxyethyl |
| M1-3 | 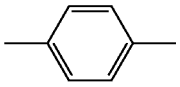 | 2-Chlorophenyl | Isopropyl | n-Butyl | 4-Methoxy phenoxyethyl |

TABLE 11

The dyes represented by the formula (M2)

| Examples of compounds | Ring I | $R^{28}$ | $R^{29}$ | $R^{30}$ | $R^{31}$ |
|---|---|---|---|---|---|
| M2-1 | 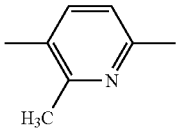 | t-Butyl | 3-Methylphenyl | Ethyl | Ethyl |
| M2-2 | 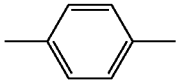 | 2-Chlorophenyl | Isopropyl | n-Butyl | Cyanoethyl |

TABLE 12

The dyes represented by the formula (M3)

| Examples of compounds | Ring J | $R^{32}$ | $R^{33}$ | $R^{34}$ |
|---|---|---|---|---|
| M3-1 | 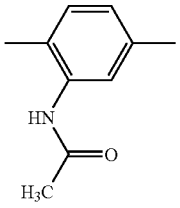 | n-Butyl | n-Butyl | n-Butyl |
| M3-2 | 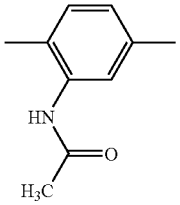 | Allyl | n-Propyl | n-Propyl |

TABLE 13

The dyes represented by the formula (M4)

| Examples of compounds | Ring K | $R^{35}$ | $R^{36}$ | $R^{37}$ |
|---|---|---|---|---|
| M4-1 | 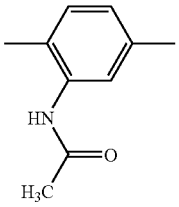 | Methyl | Ethyl | Benzyl |
| M4-2 | 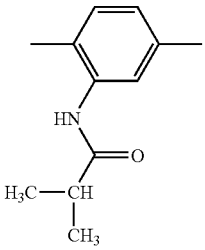 | Methyl | Ethyl | Benzyl |

TABLE 14

The dyes represented by the formula (M5)

| Examples of compounds | $R^{38}$ | $R^{39}$ | $R^{40}$ | $R^{41}$ |
|---|---|---|---|---|
| M5-1 | Methyl | t-Butyl | Ethyl | Ethyl |
| M5-2 | Phenyl | t-Butyl | Ethyl | Ethyl |
| M5-3 | Methyl | t-Butyl | n-Propyl | n-Propyl |
| M5-4 | Methyl | t-Butyl | n-Butyl | n-Butyl |

TABLE 15

The dyes represented by the formula (M6)

| Examples of compounds | $R^{42}$ | $R^{43}$ | $R^{44}$ |
|---|---|---|---|
| M6-1 | Phenoxy | Hydrogen | Hydroxyl |
| M6-2 | Phenoxy | Phenoxy | Amino |
| M6-3 | m-(N-Methylamino)phenyl | Hydrogen | Hydroxyl |

TABLE 16

The dyes represented by the formula (M7)

| Examples of compounds | Ring L | $R^{45}$ | $R^{46}$ |
|---|---|---|---|
| M7-1 | 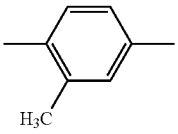 | Ethyl | Ethyl |
| M7-2 | 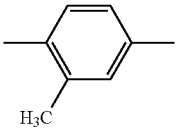 | n-Propyl | n-Propyl |

TABLE 17

The dyes represented by the formula (M8)

| Examples of compounds | Ring Q | $R^{100}$ | $R^{101}$ | $R^{102}$ | $R^{103}$ |
|---|---|---|---|---|---|
| M8-1 | 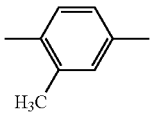 | Dimethylamino | Phenyl | Ethyl | Ethyl |
| M8-2 | 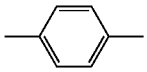 | Dimethylamino | Phenyl | Ethyl | Ethyl |
| M8-3 | 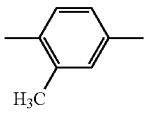 | Ethoxy | Phenyl | Ethyl | Ethyl |
| M8-4 | 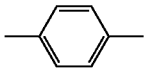 | Ethoxy | Phenyl | Ethyl | Ethyl |

TABLE 19

The dyes represented by the formula (C2)

| Examples of compounds | Ring N | $R^{52}$ | $R^{53}$ | $R^{54}$ |
|---|---|---|---|---|
| C2-1 | 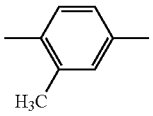 | Dimethylcarbamoyl | Ethyl | Benzyl |
| C2-2 | 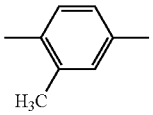 | Acetylamino | Ethyl | Ethyl |
| C2-3 | 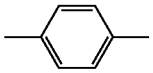 | Hydrogen | Ethyl | Isopropyl |

TABLE 18

The dyes represented by the formula (C1)

| Examples of compounds | Ring M | $R^{47}$ | $R^{48}$ | $R^{49}$ | $R^{50}$ | $R^{51}$ |
|---|---|---|---|---|---|---|
| C1-1 | 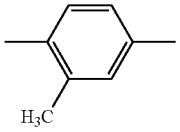 | Chloro | Methyl | Acetylamino | Ethyl | Ethyl |
| C1-2 | 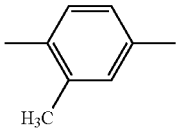 | Hydrogen | Methyl | Acetylamino | Ethyl | Ethyl |
| C1-3 | 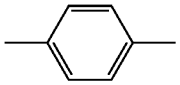 | Chloro | Hydrogen | 3-Pyridine carbonylamino | n-Propyl | n-Propyl |
| C1-4 | 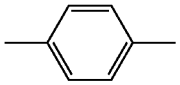 | Chloro | Methyl | Acetylamino | n-Propyl | n-Propyl |
| C1-5 | 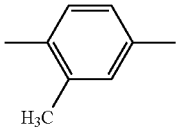 | Chloro | Ethyl | 2-Furoylamino | Ethyl | Ethyl |

TABLE 19-continued

| The dyes represented by the formula (C2) | | | | |
|---|---|---|---|---|
| Examples of compounds | Ring N | $R^{52}$ | $R^{53}$ | $R^{54}$ |
| C2-4 | 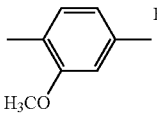 | Ethoxycarbonyl | Ethyl | Ethyl |
| C2-5 | 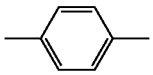 | Hydrogen | Ethyl | Ethyl |

TABLE 20

| The dyes represented by the formula (C3) | | |
|---|---|---|
| Examples of compounds | $R^{55}$ | $R^{56}$ |
| C3-1 | Isopropyl | Isopropyl |
| C3-2 | Methyl | m-Toluyl |
| C3-3 | m-Toluyl | m-Toluyl |

TABLE 21

| The dyes represented by the formula (C4) | | |
|---|---|---|
| Examples of compounds | $R^{57}$ | $R^{58}$ |
| C4-1 | Ethyl | Ethyl |
| C4-2 | n-Propyl | n-Propyl |
| C4-3 | n-Butyl | n-Butyl |

(Binder)

The resin binder contained in the dye layer in the invention may be known one. Examples thereof include acrylic resins such as polyacrylonitrile, polyacrylate, and polyacrylamide; polyvinyl acetal resins such as polyvinyl acetoacetal, and polyvinyl butyral; cellulose resins such as ethylcellulose, hydroxyethylcellulose, ethylhydroxycellulose, hydroxypropylcellulose, ethylhydroxyethylcellulose, methylcellulose, cellulose acetate, cellulose acetate butyrate, cellulose acetate propionate, cellulose nitrate, other modified cellulose resins, nitrocellulose, and ethylhydroxyethylcellulose; other resins such as polyurethane resin, polyamide resin, polyester resin, polycarbonate resin, phenoxy resin, phenol resin, and epoxy resin; and various elastomers. The dye layer may be made of at least one resin selected from the above-mentioned group.

These may be used alone, or two or more thereof may be used in the form of a mixture or copolymer. These may be crosslinked with various crosslinking agents.

The binder in the invention is preferably a cellulose resin or a polyvinyl acetal resin, more preferably a polyvinyl acetal resin. In the invention, the binder resin is in particular preferably polyvinyl acetoacetal resin, or polyvinyl butyral resin.

In the heat-sensitive transfer sheet of the invention, a dye barrier layer may be formed between the dye layer and the base film.

The surface of the base film may be subjected to treatment for easy adhesion to improve the wettability and the adhesive property of the coating liquid. Examples of the treatment include corona discharge treatment, flame treatment, ozone treatment, ultraviolet treatment, radial ray treatment, surface-roughening treatment, chemical agent treatment, vacuum plasma treatment, atmospheric plasma treatment, primer treatment, grafting treatment, and other known surface modifying treatments.

An easily-adhesive layer may be formed on the base film by coating. Examples of the resin used in the easily-adhesive layer include polyester resins, polyacrylate resins, polyvinyl acetate resins, vinyl resins such as polyvinyl chloride resin and polyvinyl alcohol resin, polyvinyl acetal resins such as polyvinyl acetoacetal and polyvinyl butyral, polyether resins, polyurethane resins, styrene acrylate resins, polyacrylamide resins, polyamide resins, polystyrene resins, polyethylene resins, and polypropylene resins.

When a film used for the base film is formed by melt extrusion, it is allowable to subject a non-drawn film to coating treatment followed by drawing treatment.

The above-mentioned treatments may be used in combination of two or more thereof.

(Transferable Protective Layer Laminate)

In the invention, a transferable protective layer laminate is preferably formed in area order onto the heat-sensitive transfer sheet. The transferable protective layer laminate is used to protect a heat-transferred image with a protective layer composed of a transparent resin, thereby to improve durability such as scratch resistance, light-fastness, and resistance to weather. This laminate is effective for a case where the transferred dye is insufficient in image durabilities such as light resistance, scratch resistance, and chemical resistance in the state that the dye is naked in the surface of an image-receiving sheet.

The transferable protective layer laminate can be formed by forming, onto a support, a releasing layer, a protective layer and an adhesive layer in this order (i.e., in the layer-described order) successively. The protective layer may be formed by plural layers. In the case where the protective layer also has functions of other layers, the releasing layer and the adhesive layer can be omitted. It is also possible to use a base film on which an easy adhesive layer has already been formed.

(Transferable Protective Layer)

As a transferable protective layer-forming resin, preferred are resins that are excellent in scratch resistance, chemical resistance, transparency and hardness. Examples of the resin include polyester resins, polystyrene resins, acrylic resins, polyurethane resins, acrylic urethane resins, silicone-modified resins of the above-described resins, ultraviolet-shielding resins, mixtures of these resins, ionizing radiation-curable resins, and ultraviolet-curing resins. Particularly preferred are polyester resins and acrylic resins.

These resins may be crosslinked with various crosslinking agents.

(Transferable Protective Layer Resin)

As the acrylic resin, use can be made of polymers derived from at least one monomer selected from conventionally known acrylate monomers and methacrylate monomers. Other monomers than these acrylate-series monomers, such as styrene and acrylonitrile may be co-polymerized with said acryl-series monomers. A preferred monomer is methyl methacrylate. It is preferred that methyl methacrylate is contained in terms of preparation mass ratio of 50 mass % or more in the polymer.

The acrylic resin in the invention preferably has a molecular weight of 20,000 or more and 100,000 or less.

The polyester resin in the invention may be a saturated polyester resin known in the prior art. As the above-described polyester resin, a preferable glass transition temperature ranges from 50° C. to 120° C., and a preferable molecular weight ranges from 2,000 to 40,000. A molecular weight ranging from 4,000 to 20,000 is more preferred, because so-called "foil-off" properties at the time of transfer of the protective layer are improved.

(Ultraviolet Absorbent)

In the protective layer transferring sheet in the invention, an ultraviolet absorbent may be incorporated into the protective layer and/or the adhesive layer. The ultraviolet absorbent may be an inorganic ultraviolet absorbent or organic ultraviolet absorbent known in the prior art.

As the organic ultraviolet absorbing agents, use as the ultraviolet-shielding resin can be made of non-reactive ultraviolet absorbing agents such as salicylate-series, benzophenone-series, benzotriazole-series, triazine-series, substituted acrylonitrile-series, and hindered amine-series ultraviolet absorbing agents; and copolymers or graft polymers of thermoplastic resins (e.g., acrylic resins) and activated products obtained by introducing to the above-described non-reactive ultraviolet absorbing agents; addition-polymerizable double bonds originated from a vinyl group, an acryroyl group, a methacryroyl group, or the like, or alternatively by introducing thereto other types of groups such as an alcoholic hydroxyl group, an amino group, a carboxyl group, an epoxy group, and an isocyanate group. In addition, disclosed is a method of obtaining ultraviolet-shielding resins by the steps of dissolving ultraviolet absorbing agents in a monomer or oligomer of the resin to be used in the protective layer, and then polymerizing the monomer or oligomer (JP-A-2006-21333, "JP-A" means unexamined published Japanese patent publication). In this case, the ultraviolet absorbing agents may be non-reactive.

Of these ultraviolet absorbing agents, preferred are benzophenone-series, benzotriazole-series, and triazine-series ultraviolet absorbing agents. It is preferred that these ultraviolet absorbers are used in combination so as to cover an effective ultraviolet absorption wavelength region according to characteristic properties of the dye that is used for image formation. Besides, in the case of non-reactive ultraviolet absorbers, it is preferred to use a mixture of two or more kinds of ultraviolet absorbers each having a different structure from each other so as to prevent the ultraviolet absorbers from precipitation.

Examples of commercially available ultraviolet absorbing agents include TINUVIN-P (trade name, manufactured by Ciba-Geigy), JF-77 (trade name, manufactured by JOHOKU CHEMICAL CO., LTD.), SEESORB 701 (trade name, manufactured by SHIRAISHI CALCIUM KAISHA, LTD.), SUMISOUB 200 (trade name, manufactured by Sumitomo Chemical Co., Ltd.), BIOSOUP 520 (trade name, manufactured by KYODO CHEMICAL CO., LTD.), and ADKSTAB LA-32 (trade name, manufactured by ADEKA).

(Formation of the Transferable Protective Layer)

The method for forming the protective layer, which depends on the kind of the resin to be used, may be the same method for forming the dye layer. The protective layer preferably has a thickness of 0.5 to 10 μm.

(Releasing Layer)

In a case where the protective layer is not easily peeled from the support in the protective layer transferring sheet when the image is thermally transferred, a releasing layer may be formed between the support and the protective layer. A peeling layer may be formed between the transferable protective layer and the releasing layer. The releasing layer may be formed by painting a coating liquid by a method known in the prior art, such as gravure coating or gravure reverse coating, and then drying the painted liquid. The coating liquid contains at least one selected from, for example, waxes, silicone waxes, silicone resins, fluorine-contained resins, acrylic resins, polyvinyl alcohol resins, cellulose derivative resins, urethane resins, vinyl acetate resins, acryl vinyl ether resins, maleic anhydride resins, and copolymers of these resins. Of these resins, preferred are: acrylic resins, such as resin obtained by homopolymerizing a (meth)acrylic monomer such as acrylic acid or methacrylic acid, or obtained by copolymerizing a methacrylic monomer with a different monomer; or cellulose derivative resins. They are each excellent in adhesive property to the support, and releasing ability from the protective layer.

These resins may be crosslinked with various crosslinking agents. Moreover, ionizing radiation curable resin and ultraviolet curable resin may be used.

The releasing layer may be appropriately selected from a releasing layer which is transferred to a transferred-image-receiving member when the image is thermally transferred, a releasing layer which remains on the support side at that time, a releasing layer which is broken out by aggregation at that time, and other releasing layers. A preferred embodiment of the invention is an embodiment wherein the releasing layer remains on the support side at the time of the thermal transfer and the interface between the releasing layer and the thermally transferable protective layer becomes a protective layer surface after the thermal transfer since the embodiment is excellent in surface gloss, the transfer stability of the protective layer, and others. The method for forming the releasing layer may be a painting method known in the prior art. The releasing layer preferably has a thickness of about 0.5 to 5 μm in the state that the layer is dried.

(Adhesive Layer)

An adhesive layer may be formed, as the topmost layer of the transferable protective layer laminate, on the topmost surface of the protective layer. This makes it possible to make the adhesive property of the protective layer to a transferred-image-receiving member good.

2) Heat-Sensitive Transfer Image-Receiving Sheet

A heat-sensitive transfer image-receiving sheet (hereinafter also referred to merely as an image-receiving sheet) will be described in detail hereinafter. The image-receiving sheet, which is used to form an image by applying heat to this sheet and the heat-sensitive transfer sheet of the invention which are put on each other by means of a thermal printer head or the like, has a sheet having a support and at least one dye-receiving layer (hereinafter also referred to merely as a receiving layer) over the support. Between the support and the receiving layer may be formed an intermediate layer such as a heat insulating layer (porous layer), a gloss control layer, a white background adjusting layer, a charge control layer, an adhesive layer, or a primer layer. The image-receiving sheet preferably has at least one heat insulating layer between the support and the receiving layer.

The dye-receiving layer and the intermediate layer are preferably formed by simultaneous multilayer-coating. If necessary, plural intermediate layers may be formed.

A curling control layer, a writing layer, or a charge-control layer may be formed on the backside of the support. Each of these layers may be applied using a usual method such as a roll coating, a bar coating, a gravure coating, and a gravure reverse coating.

(Receiving Layer)

The image-receiving sheet has at least one receiving layer containing a thermoplastic polymer which can receive the dye. The receiving layer may contain an ultraviolet absorbent, a releasing agent, a lubricant, an antioxidant, a preservative, a surfactant, and other additives.

(Thermoplastic Resin)

In the invention, a known thermoplastic resistance may be used for the receiving layer.

Preferred examples of the thermoplastic resin include polycarbonate, polyester, polyurethane, polyvinyl chloride and copolymers thereof, styrene-acrylonitrile copolymer, polycaprolactone, and mixtures thereof. Polyester, polyvinyl chloride and copolymers thereof, or mixtures thereof are more preferred. These polymers may be used alone or in a mixture form.

The above-exemplified polymers may be dissolved in a proper organic solvent such as methylethyl ketone, ethyl acetate, benzene, toluene, and xylene so that they can be coated on a support. Alternatively, they may be added to a water-based coating liquid as polymer latex so that they can be coated on a support. Polyester and polyvinyl chloride will be described in more detail hereinafter.

(Polyester Polymers)

The polyester polymers are obtained by polycondensation of a dicarboxylic acid component (including a derivative thereof) and a diol component (including a derivative thereof). The polyester polymers may contain an aromatic ring and/or an aliphatic ring. As to the alicyclic polyester, those described in JP-A-5-238167 are useful from the viewpoints of ability to incorporate a dye and image stability.

In the present invention, as the polyester polymers, it is preferable to use polyester polymers obtained by polycondensation using at least one of the above-described dicarboxylic acid component and at least one of the above-described diol component, so that the thus-obtained polyester polymers could have a molecular weight (weight-average molecular weight (Mw)) of generally about 11,000 or more, preferably about 15,000 or more, and more preferably about 17,000 or more. If polyester polymers of too low molecular weight are used, elastic coefficient of the formed receptor layer becomes low and also it raises lack of thermal resistance. Resultantly, it sometimes becomes difficult to assure the releasing property of the heat-sensitive transfer sheet and the image-receiving sheet. A higher molecular weight is more preferable from a viewpoint of increase in elastic coefficient. The molecular weight is not limited in particular, so long as such failure does not occur that a higher molecular weight makes the polymer difficult to be dissolved in a solvent for a coating solution at the time of forming the receptor layer, or that an adverse effect arises in adhesive properties of the receptor layer to the support after coating and drying the receptor layer. However, the molecular weight is preferably about 25,000 or less, and at highest a degree of about 30,000. The polyester polymers may be synthesized according to a known method.

As the polyester which is of a saturated type, for example, the following may be used: VYLONAL MD-1200, VYLONAL MD-1220, VYLONAL MD-1245, VYLONAL MD-1250, VYLONAL MD-1500, VYLONAL MD-1930, or VYLONAL MD-1985, which is a trade name, manufactured by Toyobo Co., Ltd.

(Vinyl Chloride-Series Polymers)

The vinyl chloride-series polymers, particularly a copolymer using vinyl chloride, used in the receptor layer are explained in more detail.

The monomer which is copolymerized with vinyl chloride is not particularly limited as far as the monomer is copolymerizable with vinyl chloride. Particularly preferred is vinyl acetate, an acrylic acid ester or a methacrylic acid ester. Very good examples of the copolymer include vinyl chloride-vinyl acetate copolymer, vinyl chloride-acrylic acid ester copolymer, and vinyl chloride-methacrylic acid ester copolymer. The copolymers are each not necessarily a copolymer composed only of vinyl chloride and the above-mentioned preferred monomer (i.e., vinyl acetate, an acrylic acid ester or a methacrylic acid ester), and each contain a component other than these monomers, such as a vinyl alcohol component or maleic component, as far as the attainment of the objects of the invention is not hindered. Examples of the other component, which may constitute a copolymer composed mainly of vinyl chloride and the preferred monomer(s), include vinyl alcohol, vinyl alcohol derivatives such as vinyl propionate, acrylic acid, methacrylic acid, (meth)acrylic acid derivatives such as methyl, ethyl, propyl, butyl and 2-ethylhexyl esters of the acids, maleic acid, maleic acid derivatives such as diethyl maleate, dibutyl maleate and dioctyl maleate, vinyl ether derivatives such as methyl vinyl ether, butyl vinyl ether and 2-ethylhexyl vinyl ether, acrylonitrile, methacrylonitrile, and styrene. The component ratio between vinyl chloride and the preferred monomer(s) in the copolymer may be an arbitrary ratio. The ratio by mass of the vinyl chloride component in the copolymer is preferably 50 mass % or more. The ratio by mass of the component other than vinyl chloride and the preferred monomers is preferably 10 mass % or less.

Examples of the vinyl chloride-vinyl acetate copolymer include VINYBRANE 240, VINYBRANE 601, VINYBRANE 602, VINYBRANE 380, VINYBRANE 386, VINYBRANE 410, and VINYBRANE 550, each of which is a trade name, manufactured by Nissin Chemical Industry Co., Ltd.

Examples of the vinyl chloride-acrylic acid ester copolymer include VINYBRANE 270, VINYBRANE 276, VINYBRANE 277, VINYBRANE 609, VINYBRANE 680, VINYBRANE 690, and VINYBRANE 900, each of which is a trade name, manufactured by Nissin Chemical Industry Co., Ltd.

(Latex Polymer)

In the present invention, latex polymers can also be preferably used. Hereinafter, the latex polymer will be explained.

In the heat-sensitive transfer image-receiving sheet that can be used in the present invention, the latex polymer used in the receptor layer is a dispersion in which hydrophobic polymers are dispersed as fine particles in a water-soluble dispersion medium. The dispersed particles preferably have a mean particle size (diameter) of about 1 to 50,000 nm, more preferably about 5 to 1,000 nm.

The latex polymer that can be used in the present invention may be latex of the so-called core/shell type, other than ordinary latex polymer of a uniform structure. When using a core/shell type latex polymer, it is preferred in some cases that the core and the shell have different glass transition temperatures. The glass transition temperature (Tg) of the latex polymer that can be used in the present invention is preferably −30° C. to 130° C., more preferably 0° C. to 120° C., and further more preferably 10° C. to 100° C.

In the present invention, it is preferable to prepare the receptor layer by applying an aqueous type coating solution and then drying it. The "aqueous type" so-called here means that 60% by mass or more of the solvent (dispersion medium) of the coating solution is water. As a component other than water in the coating solution, a water miscible organic solvent may be used, such as methyl alcohol, ethyl alcohol, isopropyl alcohol, dimethylformamide, ethyl acetate, diacetone alcohol, furfuryl alcohol, benzyl alcohol, diethylene glycol monoethyl ether, and oxyethyl phenyl ether.

In combination with the above-described latex polymer that can be used in the present invention, any polymer can be used. The polymer that can be used in combination is preferably transparent or translucent, and colorless. The polymer may be a natural resin, polymer, or copolymer; a synthetic resin, polymer, or copolymer; or another film-forming medium; and specific examples include gelatins, polyvinyl alcohols, hydroxyethylcelluloses, cellulose acetates, cellulose acetate butyrates, polyvinylpyrrolidones.

The glass transition temperature (Tg) of the binder that can be used in the present invention is preferably in the range of −30° C. to 90° C., more preferably −10° C. to 85° C., still more preferably 0° C. to 70° C., in view of film-forming properties (brittleness for working) and image preservability. A blend of two or more types of polymers can be used as the binder. When a blend of two or more polymers is used, the average Tg obtained by summing up the Tg of each polymer weighted by its proportion, is preferably within the foregoing range. Also, when phase separation occurs or when a core-shell structure is adopted, the weighted average Tg is preferably within the foregoing range.

[Releasing Agent]

In the present invention, a releasing agent may be used in the receptor layer in order to keep more securely the releasing property between the heat-sensitive transfer sheet and the image-receiving sheet at the time of printing images.

As the releasing agent, solid waxes such as polyethylene wax and amide wax; silicone oil, phosphate-series compounds, fluorine-based surfactants, silicone-based surfactants and others including releasing agents known in the technical fields concerned may be used. Among these, fluorine-series compounds typified by fluorine-based surfactants, silicone-based surfactants and silicone-series compounds such as silicone oil and/or its hardened products are preferably used.

In the present invention, the amount of the receptor layer to be applied is preferably 0.5 to 10 g/m$^2$ (solid basis, hereinafter, the amount to be applied in the present specification is a value on solid basis unless otherwise noted).

<Releasing Layer>

In the case where the hardened modified silicone oil is not added to the receptor layer, the silicone oil may be added to a releasing layer provided on the receptor layer. In this case, the receptor layer may be provided using at least one of the above-described thermoplastic resins. Besides, a receptor layer to which silicone is added may be used. The releasing layer contains a hardened modified silicone oil. A kind of the silicone to be used and a method of using the silicone are the same as for use in the receptor layer. Also, in the case where a catalyst or a retardant is used, the above described descriptions related to addition of these additives to the receptor layer may be applied. The releasing layer may be formed using only a silicone, or alternatively a mixture of a silicone and a binder resin having a good compatibility therewith. A thickness of the releasing layer is generally in the range of about 0.001 to about 1 g/m$^2$.

(Hollow Polymer)

In the image-receiving sheet used in the invention, its heat insulating layer preferably contains a hollow polymer and a water-soluble polymer.

The hollow polymer particles in the present invention are polymer particles having independent pores inside of the particles. Examples of the hollow polymer particles include (1) non-foaming type hollow particles obtained in the following manner: a dispersion medium, such as water, is contained inside of a capsule wall formed of a polystyrene, acryl resin, or styrene/acryl resin, and, after a coating solution is applied and dried, the dispersion medium in the particles is vaporized out of the particles, with the result that the inside of each particle forms a hollow; (2) foaming type microballoons obtained in the following manner: a low-boiling point liquid, such as butane and pentane, is encapsulated in a resin constituted of any one of polyvinylidene chloride, polyacrylonitrile, polyacrylic acid, and polyacrylate, or their mixture or polymer, and after the resin coating material is applied, it is heated to expand the low-boiling point liquid inside of the particles, whereby the inside of each particle is made to be hollow; and (3) microballoons obtained by foaming the above (2) under heating in advance, to make hollow polymer particles.

The particle size of the hollow polymer particles is preferably 0.1 to 20 μm, more preferably 0.1 to 5.0 μm, further preferably 0.2 to 3.0 μm, particularly preferably 0.3 to 1.0 μm.

The porosity of the hollow polymer is preferably from about 20 to 70%, more preferably from about 20 to 50%. The porosity of the hollow polymer is the ratio of the volume of the pores to that of the particles.

The glass transition temperature (Tg) of the hollow polymer particles is preferably 70° C. or higher, more preferably 90° C. or higher. These hollow polymer particles may be used in combinations of two or more of those, according to the need.

Such hollow polymer particles are commercially available. Specific examples of the above (1) include Rohpake 1055, manufactured by Rohm and Haas Co.; Boncoat PP-1000, manufactured by Dainippon Ink and Chemicals, Incorporated; SX866(B), manufactured by JSR Corporation; and Nippol MH5055, manufactured by Nippon Zeon (all of these product names are trade names). Specific examples of the above (2) include F-30, and F-50, manufactured by Matsumoto Yushi-Seiyaku Co., Ltd. (all of these product names are trade names). Specific examples of the above (3) include F-30E, manufactured by Matsumoto Yushi-Seiyaku Co., Ltd, and Expancel 461DE, 551DE, and 551DE20, manufactured by Nippon Ferrite (all of these product names are trade names). Among these, the hollow polymer particles of the above (1) may be preferably used.

(Water-Soluble Polymer)

The binder for the heat insulating layer may be a water-soluble polymer. The water-soluble polymer that can be used in the heat insulating layer is preferably a polymer used together with polymer latex. Herein, the "water-soluble polymer" means a polymer which dissolves, in 100 g water at 20° C., in an amount of preferably 0.05 g or more, more preferably 0.1 g or more, further preferably 0.5 g or more, and particularly preferably 1 g or more.

In the invention, the water-soluble polymer is preferably a polyvinyl alcohol, or gelatin, most preferably gelatin.

Further, the water-soluble polymers that are contained in the heat insulation layer may be cross-linked with a hardener in order to regulate cushion properties and film strength. Preferable examples of the hardener that can be used in the present invention include H-1, 4, 6, 8, and 14 in JP-A-1-214845 in page 17; compounds (H-1 to H-54) represented by one of the formulae (VII) to (XII) in U.S. Pat. No. 4,618,573, columns 13 to 23; compounds (H-1 to H-76) represented by the formula (6) in JP-A-2-214852, page 8, the lower right (particularly, H-14); and compounds described in Claim 1 in U.S. Pat. No. 3,325,287.

<Support>

The support may be a coated paper sheet, a laminate paper sheet, or a synthetic paper sheet.

<Curl Control Layer, Writing Layer or Charge Control Layer>

In the heat-sensitive transfer image-receiving sheet used in the invention, a curl control layer, a writing layer or a charge control layer may be formed on the support surface (rear surface) reverse to the support surface on which the receiving layer is formed by painting.

3) Image-Forming

In the image-forming method (system) of the present invention, imaging is achieved by superposing a heat-sensitive transfer sheet on a heat-sensitive transfer image-receiving sheet so that a heat transfer layer of the heat-sensitive transfer sheet is in contact with a receptor layer of the heat-sensitive transfer image-receiving sheet and giving thermal energy in accordance with image signals given from a thermal head.

Specifically, image-forming can be achieved by the similar manner to that as described in, for example, JP-A-2005-88545. In the present invention, a printing time is preferably less than 15 seconds, and more preferably in the range of 3 to 12 seconds, and further preferably 3 to 7 seconds, from the viewpoint of shortening a time taken until a consumer gets a print.

In order to accomplish the above-described printing time, a line speed at the time of printing is preferably 1.0 msec/line or less, and further preferably 0.65 msec/line or less. Further, from the viewpoint of improvement in transfer efficiency as one of speeding-up conditions, the maximum ultimate temperature of the thermal head at the time of printing is preferably in the range of from 180° C. to 450° C., more preferably from 200° C. to 450° C., and furthermore preferably from 350° C. to 450° C.

The method of the present invention may be utilized for printers, copying machines and the like, which employs a heat-sensitive transfer recording system. As a means for providing heat energy in the thermal transfer, any of the conventionally known providing means may be used. For example, application of a heat energy of about 5 to 100 mJ/mm$^2$ by controlling recording time in a recording device such as a thermal printer (e.g. trade name: Video Printer VY-100, manufactured by Hitachi, Ltd.), sufficiently attains the expected result. Also, the heat-sensitive transfer image-receiving sheet for use in the present invention may be used in various applications enabling thermal transfer recording, such as heat-sensitive transfer image-receiving sheets in a form of thin sheets (cut sheets) or rolls; cards; and transmittable type manuscript-making sheets, by optionally selecting the type of support.

According to the invention, it is possible to provide a heat-sensitive transfer sheet which has a heat-resistant lubricating layer good in heat resistance and lubricity in high-speed printing, and can reproduce an image in which image defects are suppressed and a high density is attained.

The present invention will be described in more detail based on the following examples, but the invention is not intended to be limited thereto. In the following Examples, the terms "part" and "%" are values by mass, unless they are indicated differently in particular.

EXAMPLES

Production of Heat-Sensitive Transfer Sheets

As a support, prepared was a polyester film, 4.5 μm in thickness, having a single surface subjected to treatment for easy adhesion, and then a heat-resistant-lubricating-layer-coating liquid, which will be detailed later, was painted onto the surface of the film not subjected to the treatment for easy adhesion so that the solid coating amount would be 1 g/m$^2$ after the liquid was dried. In the heat-resistant-lubricating-layer-coating liquid, the ratio by mole of reactive groups of polyisocyanate to those of the resin (—NCO/OH) was 1.2. Immediately after the painting, the workpiece was dried at 100° C. in an oven for 1 minute, and subsequently subjected to heat treatment so as to conduct crosslinking reaction between the isocyanate and the polyol. In this way, the workpiece was cured. The heat treatment was conducted in either one of the following manners: the workpiece was allowed to stand still at 60° C. and 5% RH for 1 day, at 60° C. and 70% RH for 1 day, and at 40° C. and 10% RH for 20 days. Herein, the "RH" means a relative humidity. After the heat treatment, unreacted isocyanate groups were checked by IR analysis. It was verified that the reactive groups reacted sufficiently according to any one of the manners.

Coating liquids, which will be detailed later, were used to form, onto the easily-adhesive layer painted surface of the thus-formed polyester film, individual heat-sensitive transfer layers in yellow, magenta and cyan, and a transferable protective layer laminate in area order by painting. In this way, a heat-sensitive transfer sheet was produced. The solid coating amount in each of the heat-sensitive transfer layers (dye layers) was set to 0.8 g/m$^2$. Immediately after these were painted, the workpiece was dried at 100° C. in an oven for 1 minute.

In the formation of the transferable protective layer laminate, a releasing-liquid-coating liquid was painted, a protective-layer-coating liquid was painted thereon, the resultant was dried, and then an adhesive-layer-coating liquid was painted thereon.

In such a way, heat-sensitive transfer sheets were produced. Of the sheets, the sheet having the heat-resistant lubricating layer subjected to the heat treatment at 60° C. and 5% RH for 1 day was named a heat-sensitive transfer sheet (101); that having the heat-resistant lubricating layer subjected to the heat treatment at 60° C. and 70% RH for 1 day was named a heat-sensitive transfer sheet (102); and that having the heat-resistant lubricating layer subjected to the heat treatment at 40° C. and 10% RH for 20 days was named a heat-sensitive transfer sheet (103).

| Heat-resistant-lubricating-layer-coating liquid | |
|---|---|
| Acrylic polyol resin | 26.0 mass parts |
| Trixylenyl phosphate | 10.5 mass parts |
| Talc | 1.0 mass part |
| Polyisocyanate (50% solution) (trade name: BIRNOCK D-750, manufactured by Dainippon Ink & Chemicals, Inc.) | 19.0 mass parts |
| Methyl ethyl ketone/toluene mixed solvent | 64 mass parts |
| **Yellow-dye-coating liquid** | |
| Dye compound (Y4-2) | 3.5 mass parts |
| Dye compound (Y7-4) | 2.9 mass parts |
| Polyvinylacetal resin (trade name: ESLEC KS-1, manufactured by Sekisui Chemical Co., Ltd.) | 7.1 mass parts |
| Polyvinylbutyral resin (trade name: DENKA BUTYRAL #6000-C, manufactured by DENKI KAGAKU KOGYOU K. K.) | 1.1 mass parts |
| Releasing agent (trade name: X-22-3000T, manufactured by Shin-Etsu Chemical Co., Ltd.) | 0.05 mass part |
| Releasing agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.15 mass part |
| Methyl ethyl ketone/toluene mixtured solvent | 84 mass parts |

-continued

| Magenta-dye-coating liquid | |
|---|---|
| Dye compound (M3-1) | 0.8 mass part |
| Dye compound (M3-2) | 6.0 mass parts |
| Dye compound (C1-2) | 0.1 mass part |
| Polyvinylacetal resin (trade name: ESLEC KS-1, manufactured by Sekisui Chemical Co., Ltd.) | 8.0 mass parts |
| Polyvinylbutyral resin (trade name: DENKA BUTYRAL #6000-C, manufactured by DENKI KAGAKU KOGYOU K. K.) | 0.2 mass part |
| Releasing agent (trade name: X-22-3000T, manufactured by Shin-Etsu Chemical Co., Ltd.) | 0.05 mass part |
| Releasing agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.15 mass part |
| Methyl ethyl ketone/toluene mixtured solvent | 84 mass parts |

| Cyan-dye-coating liquid | |
|---|---|
| Dye compound (C1-2) | 0.8 mass part |
| Dye compound (C3-1) | 8.8 mass parts |
| Polyvinylacetal resin (trade name: ESLEC KS-1, manufactured by Sekisui Chemical Co., Ltd.) | 7.4 mass parts |
| Polyvinylbutyral resin (trade name: DENKA BUTYRAL #6000-C, manufactured by DENKI KAGAKU KOGYOU K. K.) | 0.8 mass part |
| Releasing agent (trade name: X-22-3000T, manufactured by Shin-Etsu Chemical Co., Ltd.) | 0.05 mass part |
| Releasing agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.15 mass part |
| Methyl ethyl ketone/toluene mixtured solvent | 84 mass parts |

Transfer Protective Layer Laminate

On the polyester film coated with the dye layers as described above, coating solutions of a releasing layer, a protective layer and an adhesive layer each having the following composition was coated, to form a transfer protective layer laminate. Coating amounts of the releasing layer, the protective layer and the adhesive layer after drying were 0.2 g/m$^2$, 0.4 g/m$^2$ and 2.0 g/m$^2$, respectively.

| Releasing-layer-coating liquid | |
|---|---|
| Modified cellulose resin (trade name: L-30, manufactured by DAICEL CHEMICAL INDUSTRIES, LTD.) | 5.0 mass parts |
| Methyl ethyl ketone/toluene mixtured solvent | 95.0 mass parts |

| Protective-layer-coating liquid | |
|---|---|
| Acrylic resin solution (Solid content: 40%) (trade name: UNO-1, manufactured by Gifu Ceramics Limited) | 90 mass parts |
| Methanol/isopropanol mixtured solvent | 10 mass parts |

-continued

| Adhesive-layer-coating liquid | |
|---|---|
| Acrylic resin (trade name: DIANAL BR-77, manufactured by MITSUBISHI RAYON CO., LTD.) | 25 mass parts |
| The following ultraviolet absorber UV-1 | 0.5 mass part |
| The following ultraviolet absorber UV-2 | 2 mass parts |
| The following ultraviolet absorber UV-3 | 0.5 mass part |
| The following ultraviolet absorber UV-4 | 0.5 mass part |
| PMMA fine particles (polymethyl methacrylate fine particles) | 0.4 mass part |
| Methyl ethyl ketone/toluene mixtured solvent | 70 mass parts |

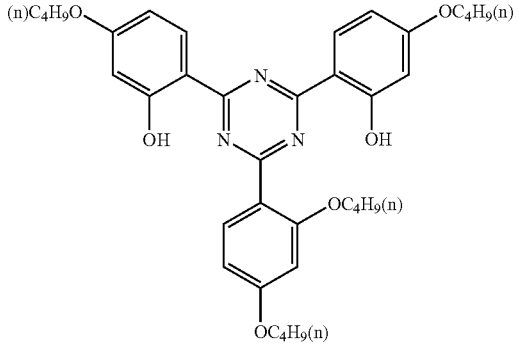

(UV-1)

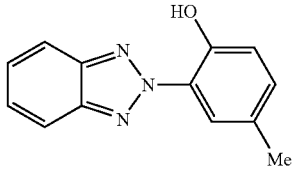

(UV-2)

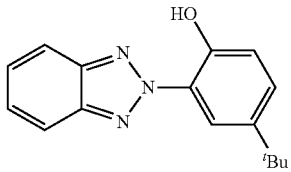

(UV-3)

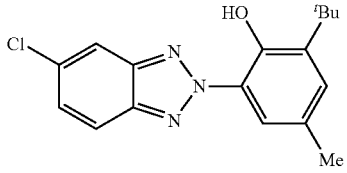

(UV-4)

Preparation of Heat Sensitive Image-Receiving Sheet

A paper support, on both sides of which polyethylene was laminated, was subjected to corona discharge treatment on the surface thereof, and then a gelatin undercoat layer containing sodium dodecylbenzenesulfonate was disposed on the treated surface. The subbing layer, the heat insulation layer, the lower receptor layer and the upper receptor layer each having the following composition were simultaneously multilayer-coated on the gelatin undercoat layer, in the state that the subbing layer, the heat insulation layer, the lower receptor layer and the upper receptor layer were laminated in this order from the side of the support, by a method illustrated in FIG. 9 in U.S. Pat. No. 2,761,791. The coating was performed so that coating amounts of the subbing layer, the heat insulation layer, the lower receptor layer, and the upper receptor layer after drying would be 6.2 g/m$^2$, 8.0 g/m$^2$, 2.8 g/m$^2$ and 2.3 g/m$^2$, respectively.

| Upper receptor layer | |
|---|---|
| Vinyl chloride-series latex (trade name: Vinybran 900, manufactured by Nisshin Chemicals Co., Ltd.) | 20.0 mass parts |
| Vinyl chloride-series latex (trade name: Vinybran 276, manufactured by Nisshin Chemicals Co., Ltd.) | 2.6 mass parts |
| Gelatin (10% solution) | 2.3 mass parts |
| The following ester-series wax EW-1 | 2.0 mass parts |
| The following surfactant F-1 | 0.09 mass part |
| The following surfactant F-2 | 0.36 mass part |
| Lower receptor layer | |
| Vinyl chloride-series latex (trade name: Vinybran 690, manufactured by Nisshin Chemicals Co., Ltd.) | 13.0 mass parts |
| Vinyl chloride-series latex (trade name: Vinybran 900, manufactured by Nisshin Chemicals Co., Ltd.) | 13.0 mass parts |
| Gelatin (10% solution) | 8.0 mass parts |
| The following surfactant F-1 | 0.04 mass part |
| Heat insulation layer | |
| Hollow latex polymer particles (trade name: MH5055, manufactured by Nippon Zeon Co., Ltd.) | 66.0 mass parts |
| Gelatin (10% solution) | 24.0 mass parts |
| Subbing layer | |
| Polyvinyl alcohol (trade name: POVAL PVA 205, manufactured by Kuraray) | 7.0 mass parts |

-continued

| | |
|---|---|
| Styrene butadiene rubber latex (trade name: SN-307, manufactured by NIPPON A & L INC) | 55.0 mass parts |
| The following surfactant F-1 | 0.03 mass part |

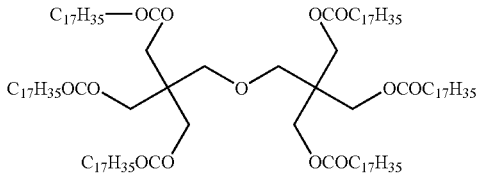

(EW-1)

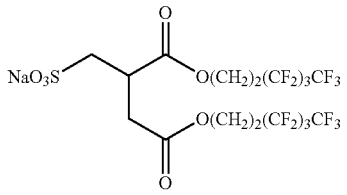

(F-1)

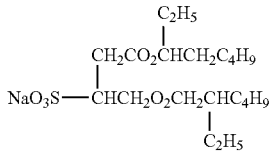

F-2

Heat-sensitive transfer sheets (104) to (119) were produced in the same way as in the production of the heat-sensitive transfer sheet (101), (102) or (103) except that the amount of the phosphate ester in the heat-resistant lubricating layer and the kind of the phosphate ester were changed and/or zinc stearate was incorporated into the layer. The structure of the heat-resistant lubricating layer of each of these heat-sensitive transfer sheets is shown in Table 22 described below.

TABLE 22

| Heat-sensitive transfer sheet sample name | Phosphate esters | Ratio (mass %) of phosphate esters to total heat-resistant lubricating layer | Ratio (mass %) of zinc stearate to total heat-resistant lubricating layer | Heat treatment conditions for crosslinking/curing of heat-resistant lubricating layer |
|---|---|---|---|---|
| 101 | Trixylenyl phosphate | 22 mass % | — | 60° C. 5% RH 1 day |
| 102 | (alkyl groups: C1) | 22 mass % | — | 60° C. 70% RH 1 day |
| 103 | | 22 mass % | — | 40° C. 10% RH 20 days |
| 104 | | 28 mass % | — | 60° C. 5% RH 1 day |
| 105 | Di(polyoxyethylene dodecyl phenyl | 22 mass % | — | 60° C. 5% RH 1 day |
| 106 | ether)phosphate | 22 mass % | — | 60° C. 70% RH 1 day |
| 107 | (alkyl groups: C12) | 22 mass % | — | 40° C. 10% RH 20 days |
| 108 | Sodium di(polyoxyethylene decyl | 22 mass % | — | 60° C. 5% RH 1 day |
| 109 | phenyl ether)phosphate | 22 mass % | — | 60° C. 70% RH 1 day |
| 110 | (alkyl groups: C10) | 22 mass % | — | 40° C. 10% RH 20 days |
| 111 | Distearyl phosphate | 22 mass % | — | 60° C. 5% RH 1 day |
| 112 | (alkyl groups: C18) | 22 mass % | — | 60° C. 70% RH 1 day |
| 113 | | 22 mass % | — | 40° C. 10% RH 20 days |
| 114 | Mixture of di(polyoxyethylene | 22 mass % | 1 mass % | 60° C. 5% RH 1 day |
| 115 | dodecyl phenyl ether)phosphate and | 22 mass % | 1 mass % | 60° C. 70% RH 1 day |
| 116 | distearyl phosphate | 22 mass % | 1 mass % | 40° C. 10% RH 20 days |
| 117 | (mass ratio: 1/2) | 4 mass % | 1 mass % | 60° C. 5% RH 1 day |
| 118 | | 6 mass % | 1 mass % | 60° C. 5% RH 1 day |
| 119 | | 28 mass % | 1 mass % | 60° C. 5% RH 1 day |

Formation, Measurement and Evaluation of Images

An electron beam was radiated onto the heat-sensitive transfer sheet (101) form the heat-resistant lubricating layer side thereof, so as to measure the characteristic X-ray intensity of the K-line of the phosphorus element therein. Specifically, a high-resolution field emission scanning electron microscope (trade name: S-4700, manufactured by Hitachi Ltd.) was used, and an energy dispersive X-ray spectrometer set up in the device was used to make the measurement. The voltage for accelerating the electron beam was set to 20 kV and the diameter of the electron beam was set to 1 μm or less. Points where the content of phosphorus was large and points where the content was small were selected. The number of the selected points was about 20 in total. The characteristic X-ray intensity originating from the K-line of phosphorus was measured in each of the points. From the maximum value and the minimum value out of the individual measured values, the ratio of the maximum value to the minimum value (the maximum value/the minimum value) was obtained. As this value is larger, the phosphate ester in the heat-resistant lubricating layer is more localized. About each of the samples, the ratio was obtained in the same way except that the sample (101) was changed to each of the samples (102) to (119).

The heat-sensitive transfer sheet (101) and the heat-sensitive transfer image-receiving sheet, 152 mm×102 mm in size, were used to output a black solid image on the image-receiving sheet by means of a heat transfer type printer.

The image-printing resolution of the heat transfer type printer was 300 dpi. The yellow, magenta, and cyan recording energies were each set to 2.5 J/cm$^2$, and the line speed was set to 1.2 msec/line and 0.6 msec/line. The highest arrival temperature of the thermal printer head (TPH) was 420° C. Moreover, a load cell was set to the thermal printer head of the printer, and the frictional force at the time of the printing was simultaneously measured. Values measured in the printings of the yellow, magenta and cyan images were averaged, and the resultant average was defined as the frictional force. As the frictional force is smaller, the lubricity is better.

A densitometer (trade name: X-rite310, manufactured by X-rite Inc.) was used to measure the reflection optical density of the resultant black solid image. In this way, the value of the transfer density of the black solid area was obtained. As a result, the density was 2.32 in the 1.2 msec/line image and 2.31 in the 0.6 msec/line image.

An image was formed and the frictional force and the transfer density were measured in the same way except that the heat-sensitive transfer sheet (101) was changed to each of the heat-sensitive transfer sheets (102) to (119).

The difference between each of the resultant transfer densities and the density of the sample (101) was obtained, and on the basis of this value, the transferability was evaluated. As this value is a larger positive value, the transfer density is favorably higher. As this value is negative and the absolute value thereof is larger, the transfer density is unfavorably lower.

The evaluation results are shown in Table 23 described below.

TABLE 23

| Heat-sensitive transfer sheet | Ratio between maximum and minimum characteristic X-ray intensities originating from | Frictional force (kgf) | | Difference between black image transfer densities | | |
|---|---|---|---|---|---|---|
| sample name | phosphorus | 1.2 ms/line | 0.6 ms/line | 1.2 ms/line | 0.6 ms/line | Remarks |
| 101 | 1.5 | 2.7 | 3.5 | ±0 | ±0 | Comparative example |
| 102 | 1.4 | 2.8 | 3.7 | +0.02 | −0.02 | Comparative example |
| 103 | 1.5 | 2.7 | 3.5 | −0.01 | ±0 | Comparative example |
| 104 | 1.4 | 1.9 | 2.8 | −0.29 | −0.55 | Comparative example |
| 105 | 6.5 | 1.5 | 1.6 | −0.04 | −0.02 | This invention |
| 106 | 1.9 | 2.3 | 3.5 | −0.19 | −0.36 | Comparative example |
| 107 | 7.8 | 1.1 | 1.2 | ±0 | −0.03 | This invention |
| 108 | 2.1 | 2.0 | 3.1 | −0.17 | −0.35 | Comparative example |
| 109 | 2.0 | 2.1 | 3.2 | −0.19 | −0.43 | Comparative example |
| 110 | 5.2 | 1.5 | 1.6 | −0.04 | −0.06 | This invention |
| 111 | 10.5 | 1.3 | 1.2 | +0.05 | −0.01 | This invention |
| 112 | 4.2 | 2.1 | 2.9 | −0.16 | −0.33 | Comparative example |
| 113 | 14.5 | 1.1 | 1.2 | +0.01 | −0.01 | This invention |
| 114 | 17.5 | 0.9 | 0.8 | +0.11 | +0.07 | This invention |
| 115 | 9.2 | 1.0 | 1.0 | +0.07 | +0.05 | This invention |
| 116 | 18.8 | 0.8 | 0.7 | +0.10 | +0.08 | This invention |
| 117 | 6.1 | 1.4 | 1.5 | +0.11 | +0.10 | This invention |
| 118 | 15.5 | 1.0 | 0.9 | +0.10 | +0.07 | This invention |
| 119 | 6.8 | 1.3 | 1.2 | −0.03 | −0.06 | This invention |

From Table 23, the following are understood: according to the samples (101) to (103), wherein only a compound having no hydroxyl group was used as a phosphate ester, such samples are unsuitable for high-speed print since the samples exhibit a large frictional force, in particular, when the image printing speed (line speed) is made large. According to the sample (104), wherein the amount of a phosphate ester was made larger than that in the sample (101), the frictional force is slightly decreased but the black image transfer density lowers largely in such samples.

Japanese Patent No. 2,591,636 states that the heat-resistant lubricating layer is turned to a hard layer having a high crosslinkage degree by using an excessive amount of polyisocyanate so as to exhibit a sufficient heat resistance and a sufficient lubricity, and a high-density crosslinked body is formed by reaction between water and polyisocyanate. In the invention, however, as compared with the sample (101), wherein heat treatment was conducted at high temperature and low humidity, the sample (102), wherein heat treatment was conducted at high temperature and high humidity, had the same frictional force or a poorer frictional force; therefore, the effect described in the publication of the patent, that is, the effect of the heat treatment at high temperature and high humidity is not exhibited.

According to the samples (105) to (113), wherein a compound having a hydroxyl group is used as a phosphate ester, in such samples the ratio between the maximum and minimum intensities of the characteristic X-ray originating from the phosphorus element can be made as large as 5 or more (that is, the phosphate ester can be localized in the heat-resistant lubricating layer) by selecting conditions for the heat treatment. Simultaneously, a fall in the black image transfer density can be restrained and the frictional force can be lowered.

According to the samples (105), (108) and (111), samples wherein a compound having an alkyl group having 12 to 18 carbon atoms is used as a phosphate ester having a hydroxyl group are more preferred since heat treatment for the samples can be attained at high temperature in a short period.

According to the samples (114) to (116), wherein a small amount of zinc stearate was used together, in such samples the heat-resistant lubricating layer can be cured at high temperature in a short period. Additionally, even if the samples are put in a high temperature and high humidity environment, the advantageous effects of the invention can be kept. Thus, the samples are more preferred from the viewpoint of storage stability.

According to the samples (114) to (117) and (119), the advantageous effects are most satisfactorily exhibited when the content by percentage of a phosphate ester in the heat-resistant lubricating layer is from 5 to 25 mass %.

From all of the results, it is evident that: when the ratio between the maximum and minimum intensities of the characteristic X-ray originating from the phosphorus element is 5 or more in samples produced by use of a phosphate ester specified in the invention, a fall in the black image transfer density can be restrained and the frictional force can be lowered; and when the ratio is 10 or more, more effective results are produced.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119(a) on Patent Application No. 2007-223207 filed in Japan on Aug. 29, 2007, which is entirely herein incorporated by reference.

I claim:

1. A heat-sensitive transfer sheet comprising a base film, a dye layer formed over one surface of the base film and containing a heat-transferable dye and a resin, and a heat-resistant lubricating layer formed over the other surface of the base film and containing a lubricant and a resin, wherein the heat-resistant lubricating layer contains a phosphate ester represented by the following formula (I) and at least one of a polyvalent metal salt of an alkylcarboxylic acid and a phosphate ester polyvalent metal salt as the lubricant, and the maximum value of the following characteristic X-ray intensities is at least 5 times the minimum value thereof: characteristic X-ray intensities obtained by radiating an electron beam which is accelerated to 20 kV and has a beam diameter of 1 μm or less onto plural positions of the heat-sensitive transfer sheet from the heat-resistant lubricating layer side of this sheet, and measuring the resultant characteristic X-rays originating from the K-line of the phosphorus element in the heat-resistant lubricating layer by means of an energy dispersive X-ray spectrometer:

Formula (I)

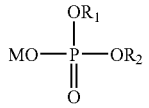

wherein M represents a hydrogen atom or a monovalent metal, $R_1$ represents a hydrogen atom, a monovalent metal, an alkyl group which may have a substituent, an alkenyl group which may have a substituent, or an aromatic group which may have a substituent, and $R_2$ represents an alkyl group which may have a substituent, an alkenyl group which may have a substituent, or an aromatic group which may have a substituent.

2. The heat-sensitive transfer sheet according to claim 1, wherein the phosphate ester represented by Formula (I) has an alkyl group having 12 to 18 carbon atoms.

3. The heat-sensitive transfer sheet according to claim 1, wherein both of $R_1$ and $R_2$ represent $—CH_2CH_2—O—(CH_2CH_2O)_n—R_3$, wherein n is a number of 1 to 20, and $R_3$ is an alkyl or aryl group which may have a substituent.

4. The heat-sensitive transfer sheet according to claim 1, wherein the maximum value of the characteristic X-ray intensities is at least 10 times the minimum value thereof.

5. The heat-sensitive transfer sheet according to claim 1, wherein the heat-resistant lubricating layer contains a polyvalent metal salt of an alkylcarboxylic acid.

6. The heat-sensitive transfer sheet according to claim 1, wherein the total coating mass of the phosphate ester represented by Formula (I) and the phosphate ester polyvalent metal salt in the heat-resistant lubricating layer is 5% or more and 25% or less of the total coating mass of the heat-resistant lubricating layer.

7. The heat-sensitive transfer sheet according to claim 1, wherein the above-described heat-sensitive transfer sheet contains at least one dye represented by any one of following formulae (Y1) to (Y9) set forth below:

Formula (Y1)

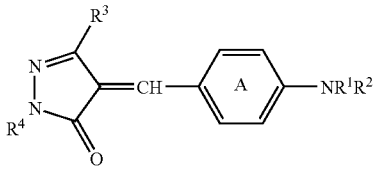

wherein the ring A represents a substituted or unsubstituted benzene ring; $R^1$ and $R^2$ each independently represent a hydrogen atom, a substituted or unsubstituted alkyl group, a substituted or unsubstituted alkenyl group or a substituted or unsubstituted aryl group; $R^3$ represents a hydrogen atom, a substituted or unsubstituted alkyl group, a substituted or unsubstituted amino group, a substituted or unsubstituted alkoxy group, a substituted or unsubstituted aryloxy group, a substituted or unsubstituted alkoxycarbonyl group, a substituted or unsubstituted aryloxycarbonyl group, a substituted or unsubstituted aryl group, or a substituted or unsubstituted carbamoyl group; and $R^4$ represents a substituted or unsubstituted alkyl group, or a substituted or unsubstituted aryl group;

Formula (Y2)

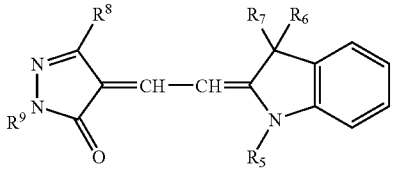

wherein $R^5$ represents a substituted or unsubstituted alkyl group, or a substituted or unsubstituted alkenyl group, $R^6$ and $R^7$ each independently represent a substituted or unsubstituted alkyl group, $R^8$ represents a substituted or unsubstituted alkyl group, a substituted or unsubstituted aryl group, a substituted or unsubstituted alkoxy group, or a substituted or unsubstituted amino group, and $R^9$ represents a substituted or unsubstituted alkyl group, or a substituted or unsubstituted aryl group;

Formula (Y3)

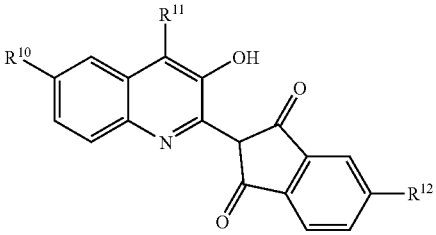

wherein $R^{10}$ represents a hydrogen atom, or a substituted or unsubstituted alkyl group, $R^{11}$ represents a hydrogen atom or a halogen atom, and $R^{12}$ represents a substituted or unsubstituted alkoxycarbonyl group, a substituted or unsubstituted aryloxycarbonyl group, or a substituted or unsubstituted carbamoyl group;

Formula (Y4)

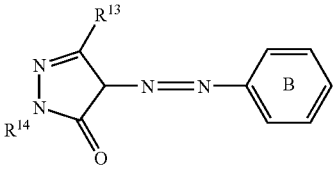

wherein the ring B represents a substituted or unsubstituted aryl group, or a substituted or unsubstituted aromatic heterocyclic group, $R^{13}$ represents a substituted or unsubstituted alkyl group, and $R^{14}$ represents a substituted or unsubstituted alkyl group, or a substituted or unsubstituted aryl group;

Formula (Y5)

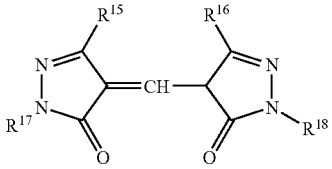

wherein $R^{15}$, $K^{16}$, $R^{17}$ and $R^{18}$ each independently represent a substituted or unsubstituted alkyl group or a substituted or unsubstituted aryl group;

Formula (Y6)

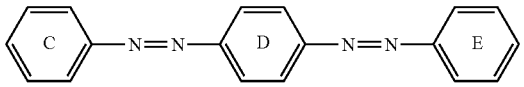

wherein the rings C, D and E each independently represent a substituted or unsubstituted benzene ring;

Formula (Y7)

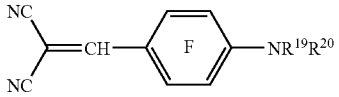

wherein the ring F represents a substituted or unsubstituted benzene ring; and $R^{19}$ and $R^{20}$ each independently represent a hydrogen atom, a substituted or unsubstituted alkyl group, a substituted or unsubstituted alkenyl group or a substituted or unsubstituted aryl group;

Formula (Y8)

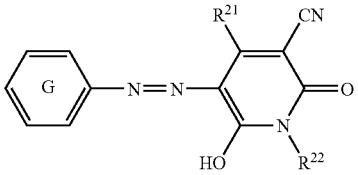

wherein the ring G represents a substituted or unsubstituted benzene ring; and $R^{21}$ and $R^{22}$ each independently represent a hydrogen atom or a substituted or unsubstituted alkyl group; and Formula (Y9)

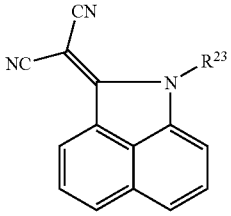

wherein $R^{23}$ represents a substituted or unsubstituted alkyl group or a substituted or unsubstituted alkenyl group.

8. The heat-sensitive transfer sheet according to claim 1, wherein the above-described heat-sensitive transfer sheet contains at least one dye represented by any one of following formulae (M1) to (M8) set forth below:

Formula (M1)

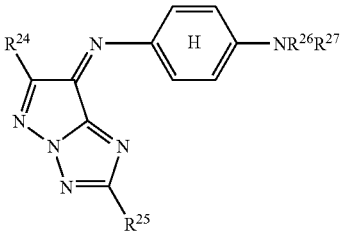

wherein the ring H represents a substituted or unsubstituted benzene ring or a substituted or unsubstituted pyridine ring; and $R^{24}$, $R^{25}$, $R^{26}$ and $R^{27}$ each independently represent a substituted or unsubstituted alkyl group, a substituted or unsubstituted alkenyl group or a substituted or unsubstituted aryl group;

Formula (M2)

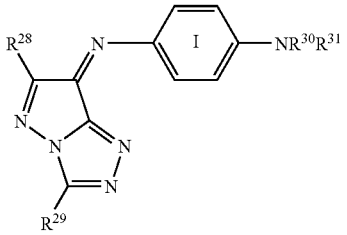

wherein the ring I represents a substituted or unsubstituted benzene ring or a substituted or unsubstituted pyridine ring; and $R^{28}$, $R^{29}$, $R^{30}$ and $R^{31}$ each independently represent a substituted or unsubstituted alkyl group, a substituted or unsubstituted alkenyl group or a substituted or unsubstituted aryl group;

Formula (M3)

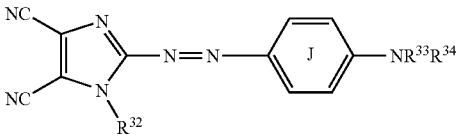

wherein the ring J represents a substituted or unsubstituted benzene ring, and $R^{32}$, $R^{33}$ and $R^{34}$ each independently represent a substituted or unsubstituted alkyl group, a substituted or unsubstituted alkenyl group or a substituted or unsubstituted aryl group;

Formula (M4)

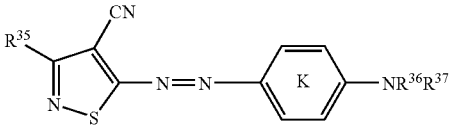

wherein the ring K represents a substituted or unsubstituted benzene ring, and $R^{35}$, $R^{36}$ and $R^{37}$ each independently represent a substituted or unsubstituted alkyl group, a substituted or unsubstituted alkenyl group or a substituted or unsubstituted aryl group;

Formula (M5)

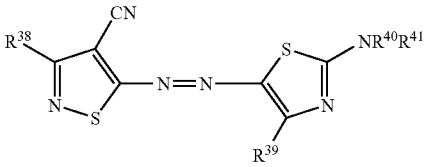

wherein $R^{38}$ and $R^{39}$ each independently represent a substituted or unsubstituted alkyl group, a substituted or unsubstituted aryl group, or a substituted or unsubstituted heterocyclic group, and $R^{40}$ and $R^{41}$ each independently represent a substituted or unsubstituted alkyl group, a substituted or unsubstituted alkenyl group, or a substituted or unsubstituted aryl group;

Formula (M6)

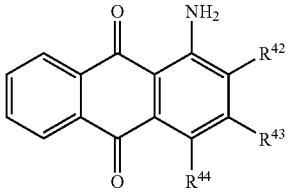

wherein $R^{42}$ is a substituted or unsubstituted aryloxy group, $R^{43}$ is a hydrogen atom, or a substituted or unsubstituted aryloxy group, and $R^{44}$ is a hydroxyl group, or a substituted or unsubstituted amino group;

Formula (M7)

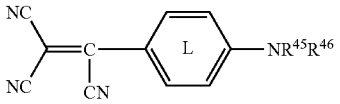

wherein the ring L represents a substituted or unsubstituted benzene ring; and $R^{45}$ and $R^{46}$ each independently represent a hydrogen atom, a substituted or unsubstituted alkyl group, a substituted or unsubstituted alkenyl group or a substituted or unsubstituted aryl group; and Formula (M8)

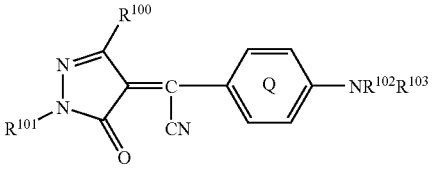

wherein the ring Q represents a substituted or unsubstituted benzene ring, $R^{100}$ represents a substituted or unsubstituted alkyl group, a substituted or unsubstituted aryl group, a substituted or unsubstituted alkoxy group, or a substituted or unsubstituted amino group, $R^{101}$ represents a substituted or unsubstituted alkyl group, or a substituted or unsubstituted aryl group, $R^{102}$ and $R^{103}$ each independently represent a hydrogen atom, a substituted or unsubstituted alkyl group, a substituted or unsubstituted alkenyl group, or a substituted or unsubstituted aryl group.

9. The heat-sensitive transfer sheet according to claim 1, wherein the above-described heat-sensitive transfer sheet contains at least one dye represented by any one of following formulae (C1) to (C4) set forth below:

Formula (C1)

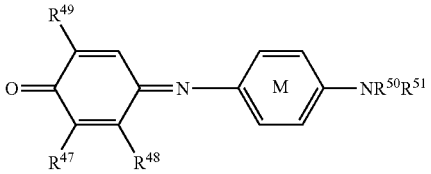

wherein the ring M represents a substituted or unsubstituted benzene ring, $R^{47}$ represents a hydrogen atom or a halogen atom, $R^{48}$ represents a substituted or unsubstituted alkyl group, $R^{49}$ represents a substituted or unsubstituted acylamino group or a substituted or unsubstituted alkoxycarbonylamino group, and $R^{50}$ and $R^{51}$ each independently represent a substituted or unsubstituted alkyl group, a substituted or unsubstituted alkenyl group or a substituted or unsubstituted aryl group;

Formula (C2)

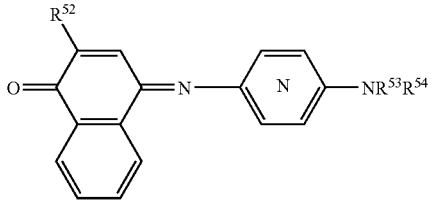

wherein the ring N represents a substituted or unsubstituted benzene ring, $R^{52}$ represents a hydrogen atom, a substituted or unsubstituted acylamino group, a substituted or unsubstituted alkoxycarbonyl group, or a substituted or unsubstituted carbamoyl group, and $R^{53}$ and $R^{54}$ each independently represent a substituted or unsubstituted alkyl group, a substituted or unsubstituted alkenyl group, or a substituted or unsubstituted aryl group;

Formula (C3)

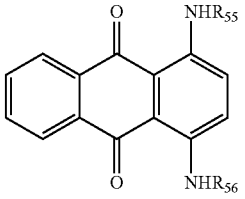

wherein $R^{55}$ and $R^{56}$ each independently represent an alkyl group, or a substituted or unsubstituted aryl group; and Formula (C4)

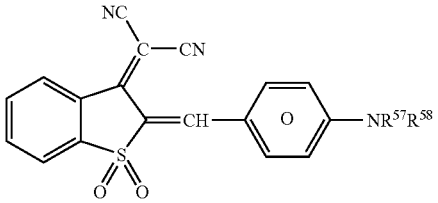

wherein the ring O represents a substituted or unsubstituted benzene ring, and $R^{57}$ and $R^{58}$ each independently represent a substituted or unsubstituted alkyl group, a substituted or unsubstituted alkenyl group, or a substituted or unsubstituted aryl group.

10. An image formation method in which images are formed in a state that the heat-sensitive transfer sheet according to claim 1 is superposed upon a heat-sensitive transfer image-receiving sheet having at least one dye-receiving layer on a support.

11. The image formation method according to claim 10, wherein the heat-sensitive transfer image-receiving sheet has at least one dye-receiving layer on a support, and further has at least one heat insulation layer containing hollow polymeric particles and a hydrophilic polymer between the dye-receiving layer and the support.

12. A heat-sensitive transfer sheet comprising a base film, a dye layer formed over one surface of the base film and containing a heat-transferable dye and a resin, and a heat-resistant lubricating layer formed over the other surface of the base film and containing a lubricant and a resin, wherein the heat-resistant lubricating layer contains a phosphate ester represented by the following formula (I) and at least one of a polyvalent metal salt of an alkylcarboxylic acid and a phosphate ester polyvalent metal salt as the lubricant, and the maximum value of the following characteristic X-ray intensities is at least 5 times the minimum value thereof: characteristic X-ray intensities obtained by radiating an electron beam which is accelerated to 20 kV and has a beam diameter of 1 μm or less onto plural positions of the heat-sensitive transfer sheet from the heat-resistant lubricating layer side of this sheet, and measuring the resultant characteristic X-rays originating from the K-line of the phosphorus element in the heat-resistant lubricating layer by means of an energy dispersive X-ray spectrometer:

Formula (I)

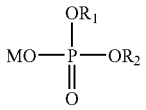

wherein M represents a hydrogen atom or a monovalent metal, $R_1$ represents a hydrogen atom, a monovalent metal, an alkyl group which may have a substituent, an alkenyl group which may have a substituent, or an aromatic group which may have a substituent, and $R_2$ represents an alkyl group which may have a substituent, an alkenyl group which may have a substituent, or an aromatic group which may have a substituent; and wherein the polyvalent metal salt of an alkylcarboxylic acid comprises zinc stearate, the phosphate ester polyvalent metal salt comprises zinc stearyl phosphate, and the heat-resistant lubricating layer contains at least one of zinc stearate and zinc stearyl phosphate in addition to the phosphate ester represented by formula (I).

13. A heat-sensitive transfer sheet comprising a base film, a dye layer formed over one surface of the base film and containing a heat-transferable dye and a resin, and a heat-resistant lubricating layer formed over the other surface of the base film and containing a lubricant and a resin, wherein the heat-resistant lubricating layer contains a phosphate ester represented by the following formula (I) and at least one of a polyvalent metal salt of an alkylcarboxylic acid and a phosphate ester polyvalent metal salt as the lubricant, and the maximum value of the following characteristic X-ray intensities is at least 5 times the minimum value thereof: characteristic X-ray intensities obtained by radiating an electron beam which is accelerated to 20 kV and has a beam diameter of 1 μm or less onto plural positions of the heat-sensitive transfer sheet from the heat-resistant lubricating layer side of this sheet, and measuring the resultant characteristic X-rays originating from the K-line of the phosphorus element in the heat-resistant lubricating layer by means of an energy dispersive X-ray spectrometer:

Formula (I)

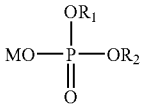

wherein M represents a hydrogen atom or a monovalent metal, $R_1$ represents a hydrogen atom, a monovalent metal, an alkyl group which may have a substituent, an alkenyl group which may have a substituent, or an aromatic group which may have a substituent, and $R_2$ represents an alkyl group which may have a substituent, an alkenyl group which may have a substituent, or an aromatic group which may have a substituent; and wherein the heat-resistant lubricating layer contains zinc stearate.

14. A heat-sensitive transfer sheet comprising a base film, a dye layer formed over one surface of the base film and containing a heat-transferable dye and a resin, and a heat-resistant lubricating layer formed over the other surface of the base film and containing a lubricant and a resin, wherein the heat-resistant lubricating layer contains a phosphate ester represented by the following formula (I) and at least one of a polyvalent metal salt of an alkylcarboxylic acid and a phosphate ester polyvalent metal salt as the lubricant, and the maximum value of the following characteristic X-ray intensities is at least 5 times the minimum value thereof: characteristic X-ray intensities obtained by radiating an electron beam which is accelerated to 20 kV and has a beam diameter of 1 μm or less onto plural positions of the heat-sensitive transfer sheet from the heat-resistant lubricating layer side of this sheet, and measuring the resultant characteristic X-rays originating from the K-line of the phosphorus element in the heat-resistant lubricating layer by means of an energy dispersive X-ray spectrometer:

Formula (I)

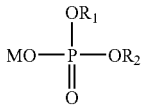

wherein M represents a hydrogen atom or a monovalent metal, $R_1$ represents a hydrogen atom, a monovalent metal, an alkyl group which may have a substituent, an alkenyl group which may have a substituent, or an aromatic group which may have a substituent, and $R_2$ represents an alkyl group which may have a substituent, an alkenyl group which may have a substituent, or an aromatic group which may have a substituent; and wherein the heat-resistant lubricating layer contains zinc stearyl phosphate.

* * * * *